US009170558B2

(12) United States Patent
Ikuno et al.

(10) Patent No.: US 9,170,558 B2
(45) Date of Patent: Oct. 27, 2015

(54) IMAGE FORMING APPARATUS AND PROCESS CARTRIDGE INCLUDING A CLEANING BLADE WHICH INCLUDES A CURED COMPOSITION

(71) Applicants: Hiroshi Ikuno, Kanagawa (JP); Tetsuya Toshine, Shizuoka (JP); Masanobu Gondoh, Kanagawa (JP); Shinji Nohsho, Tokyo (JP); Shohei Gohda, Kanagawa (JP); Kaori Toyama, Kanagawa (JP)

(72) Inventors: Hiroshi Ikuno, Kanagawa (JP); Tetsuya Toshine, Shizuoka (JP); Masanobu Gondoh, Kanagawa (JP); Shinji Nohsho, Tokyo (JP); Shohei Gohda, Kanagawa (JP); Kaori Toyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/471,484

(22) Filed: Aug. 28, 2014

(65) Prior Publication Data

US 2015/0071678 A1 Mar. 12, 2015

(30) Foreign Application Priority Data

Sep. 12, 2013 (JP) ..... 2013-189310
Jun. 19, 2014 (JP) ..... 2014-126153

(51) Int. Cl.
*G03G 21/16* (2006.01)
*G03G 15/00* (2006.01)
*G03G 21/00* (2006.01)

(52) U.S. Cl.
CPC ..... *G03G 21/0017* (2013.01); *G03G 15/75* (2013.01); *G03G 21/169* (2013.01); *G03G 2215/00957* (2013.01)

(58) Field of Classification Search
CPC ..... G03G 21/0017; G03G 21/169
See application file for complete search history.

(56) References Cited

U.S. PATENT DOCUMENTS

| | | | | |
|---|---|---|---|---|
| 6,686,114 | B2 | 2/2004 | Sakon et al. | |
| 8,535,863 | B2 | 9/2013 | Asano et al. | |
| 2002/0115005 | A1 | 8/2002 | Ikuno et al. | |
| 2004/0170841 | A1 * | 9/2004 | Tomiyama et al. | 428/422.8 |
| 2004/0240915 | A1 * | 12/2004 | Nakayama | 399/345 |

(Continued)

FOREIGN PATENT DOCUMENTS

| | | |
|---|---|---|
| JP | 2002-341571 | 11/2002 |
| JP | 2004-233881 | 8/2004 |

(Continued)

OTHER PUBLICATIONS

U.S. Appl. No. 14/155,716, filed Jan. 15, 2014.

*Primary Examiner* — Sandra Brase
(74) *Attorney, Agent, or Firm* — Oblon, McClelland, Maier & Neustadt, L.L.P.

(57) ABSTRACT

An image forming apparatus, which contains: an image bearing member; a charging unit; an exposing unit; a developing unit; a transferring unit; and a cleaning unit, wherein the image bearing member contains an electrically conductive support, a photoconductive layer formed on the electrically conductive support, and a surface layer containing a binder resin and particles formed on a surface of the photoconductive layer, or contains the electrically conductive support, and the photoconductive layer formed on the electrically conductive support, wherein the cleaning unit contains a cleaning blade, which contains a cured composition containing a curing agent in a region of the cleaning blade, which is to be in contact with the image bearing member, and wherein the curing agent contains a polycyclic aliphatic hydrocarbon group, and a (meth)acryloyloxy group.

8 Claims, 8 Drawing Sheets

(56) References Cited

U.S. PATENT DOCUMENTS

| | | | | |
|---|---|---|---|---|
| 2006/0216084 | A1* | 9/2006 | Kojima et al. | 399/350 |
| 2008/0080914 | A1* | 4/2008 | Sugimoto | 399/350 |
| 2009/0311017 | A1 | 12/2009 | Ohmori et al. | |
| 2011/0200924 | A1* | 8/2011 | Kami et al. | 430/56 |
| 2013/0243506 | A1 | 9/2013 | Ikuno et al. | |
| 2013/0244150 | A1 | 9/2013 | Toshine et al. | |
| 2014/0064810 | A1 | 3/2014 | Iwamoto et al. | |

FOREIGN PATENT DOCUMENTS

| | | |
|---|---|---|
| JP | 3602898 | 10/2004 |
| JP | 2010-152295 | 7/2010 |
| JP | 2011-145457 | 7/2011 |

* cited by examiner

IMAGE FORMING APPARATUS AND PROCESS CARTRIDGE INCLUDING A CLEANING BLADE WHICH INCLUDES A CURED COMPOSITION

BACKGROUND OF THE INVENTION

1. Field of the Invention

The present invention relates to an image forming apparatus and a process cartridge.

2. Description of the Related Art

In an electrophotographic image forming apparatus, conventionally, a toner remained on a surface of an image bearing member after transferring a toner image to a recording medium or an intermediate transfer member is removed by a cleaning unit.

As for the cleaning unit, a cleaning blade has been used, as a structure thereof is simple.

A cleaning blade is typically constructed by supporting an edge part of an elastic member with a support member, and stops the toner remained on a surface of an image bearing member, and scrap the toner off to remove the remained toner on the surface, by pressing the end ridge part of the elastic member onto the surface of the image bearing member.

There is however a problem that a cleaning failure occurs.

In Japanese Patent Application Laid-Open (JP-A) No. 2010-152295 (PTL 1), disclosed is a cleaning blade, which is brought into contact with a surface of a member to be cleaned to thereby remove a powder from the surface of the member to be cleaned. The cleaning blade is composed of an elastic body blade, an end ridge part of which has the friction coefficient of 0.5 or less, and a surface layer, which covers the end ridge part of the elastic body blade, has a layer thickness of 1 μm to 50 μm at the position that is 50 μm apart from the end ridge part, and is harder than the elastic body blade.

Meanwhile, there is a problem that an image bearing member is abraded by a contact with a cleaning blade.

In JP-A No. 2011-145457 (PTL 2), disclosed is an image forming apparatus equipped with an electrophotographic photoconductor containing an electrically conductive support, and a photoconductive layer and surface layer provided on the electrically conductive support, and a cleaning blade. The surface layer is a cured layer containing filler.

SUMMARY OF THE INVENTION

If the cleaning blade of PTL 1 in the image forming apparatus of PTL 2, however, there is a problem that foreign matter is adhered on a surface of the image bearing member.

Considering the aforementioned problems in the art, aspects of the present invention aim to provide an image forming apparatus and a process cartridge, which have excellent cleaning properties of a cleaning blade and abrasion resistance of an image bearing member, and can prevent an occurrence of foreign matter adhesion on the image bearing member.

In one aspect of the present invention, an image forming apparatus contains:

an image bearing member;

a charging unit configured to charge the image bearing member;

an exposing unit configured to expose the charged image bearing member to light to form an electrostatic latent image;

a developing unit configured to develop the electrostatic latent image formed on the image bearing member with a toner to form a toner image;

a transferring unit configured to transfer the toner image formed on the image bearing member to a recording medium; and a cleaning unit configured to clean the image bearing member from which the toner image has been transferred, wherein the image bearing member is an image bearing member containing an electrically conductive support, a photoconductive layer formed on the electrically conductive support, and a surface layer containing a binder resin and particles formed on a surface of the photoconductive layer, or an image bearing member containing an electrically conductive support, and a photoconductive layer containing a binder resin and particles formed on the electrically conductive support, wherein the cleaning unit contains a cleaning blade, which contains a cured composition containing a curing agent in a region of the cleaning blade, which is to be in contact with the image bearing member, and wherein the curing agent contains a polycyclic aliphatic hydrocarbon group, and a (meth)acryloyloxy group.

In one aspect of the present invention, a process cartridge contains:

an image bearing member; and a cleaning unit configured to clean the image bearing member from which a toner image has been transferred, wherein the image bearing member is an image bearing member containing an electrically conductive support, a photoconductive layer formed on the electrically conductive support, and a surface layer containing a binder resin and particles formed on a surface of the photoconductive layer, or an image bearing member containing an electrically conductive support, and a photoconductive layer containing a binder resin and particles formed on the electrically conductive support, wherein the cleaning unit contains a cleaning blade, which contains a cured composition containing a curing agent in a region of the cleaning blade, which is to be in contact with the image bearing member, and wherein the curing agent contains a polycyclic aliphatic hydrocarbon group, and a (meth)acryloyloxy group.

According to the aspects of the present invention, an image forming apparatus and a process cartridge, which have excellent cleaning properties of a cleaning blade and abrasion resistance of an image bearing member, and can prevent an occurrence of foreign matter adhesion on the image bearing member, can be provided.

DETAILED DESCRIPTION OF THE INVENTION

Image Forming Apparatus

Next, an embodiment for carrying out the present invention is explained.

Figure 1:
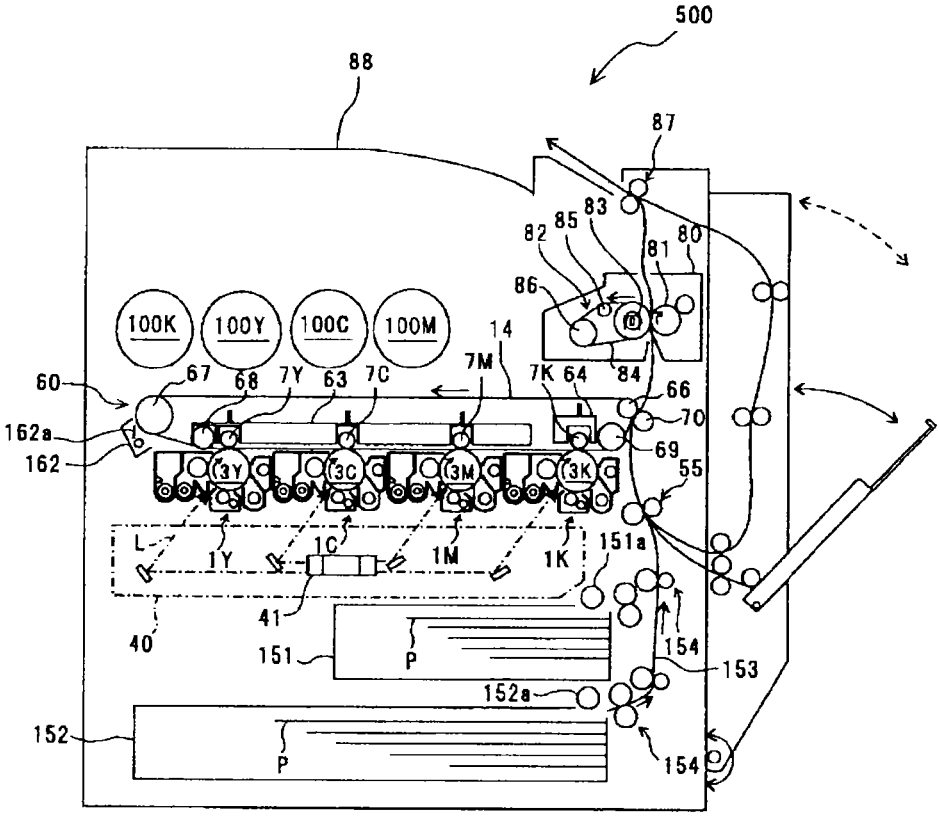
FIG. 1 is a schematic configuration diagram illustrating one example of the image forming apparatus.

FIG. 1 illustrates one example of the image forming apparatus.

The image forming apparatus 500 contains four image forming units 1Y, 1C, 1M, 1K, which are for yellow (Y), magenta (M), cyan (C), and black (K), respectively. The image forming units 1Y, 1C, 1M, 1K have the same structure, provided that the color of the toner for use is different from each other.

At the upper side of the image forming units 1Y, 1C, 1M, 1K, a transfer unit 60 equipped with an intermediate transfer belt 14 is provided. The toner images formed on surfaces of the image bearing members 3Y, 3C, 3M, 3K, which are respectively provided in the image forming units 1Y, 1C, 1M, 1K, are superimposed and transferred on a surface of the intermediate transfer belt 14.

Moreover, an exposure unit 40 is provided at the bottom of the image forming units 1Y, 1C, 1M, 1K. The exposure unit 40 is configured to apply laser light L to each of the image forming members 3Y, 3C, 3M, 3K based on image information. As a result, electrostatic latent images are respectively formed on the surfaces of the image bearing members 3Y, 3C, 3M, 3K. The exposure unit 40 is configured to apply laser light L to the image bearing members 3Y, 3C, 3M, 3K through a plurality of optical lenses or mirrors, while polarizing the light with a polygon mirror 41 that is rotationally driven by a motor.

Note that, the exposure unit 40 may perform light scanning with an LED array.

At the bottom of the exposure unit 40, a first paper feeding cassette 151 and a second paper feeding cassette 152 are provided in a manner that they are overlapped in the vertical direction. In each of the first paper feeding cassette 151 and the second paper feeding cassette 152, recording media P are housed in the state of a paper bundle where a plurality of sheets are stacked. A recording medium P placed on the top in each cassette is in contact with a first paper feeding roller 151*a* and a second paper feeding roller 152*a*, respectively. Once the first paper feeding roller 151*a* is rotationally driven in the anticlockwise direction of the diagram by a driving unit (not illustrated), a recording medium P placed on top in the first paper feeding cassette 151 is discharged to a paper feeding path 153 provided in the vertical direction at the right side of the first paper feeding cassette 151. Once the second paper feeding roller 152*a* is rotationally driven in the anticlockwise direction of the diagram by a driving unit (not illustrated), moreover, a recording medium P placed on top in the second paper feeding cassette 152 is discharged to the paper feeding path 153.

Pluralities of a pair of convey rollers 154 are provided in the paper feeding path 153. The recording medium P sent to the paper feeding path 153 is conveyed from the bottom to the top within the paper feeding path 153 in the drawing with being nipped with the pair of the convey rollers 154.

A pair of registration rollers 55 is provided at the downstream end part of the paper feeding path 153 relative to the traveling direction of the recording medium P. Once the pair of the registration rollers 55 nip therebetween the recording medium P transported from the pair of the convey rollers 154, the rotation of the pair of the convey rollers 154 is stopped temporarily. Then, the recording medium P is sent to the below-mentioned secondary transfer nip at the appropriate timing.

Figure 2:
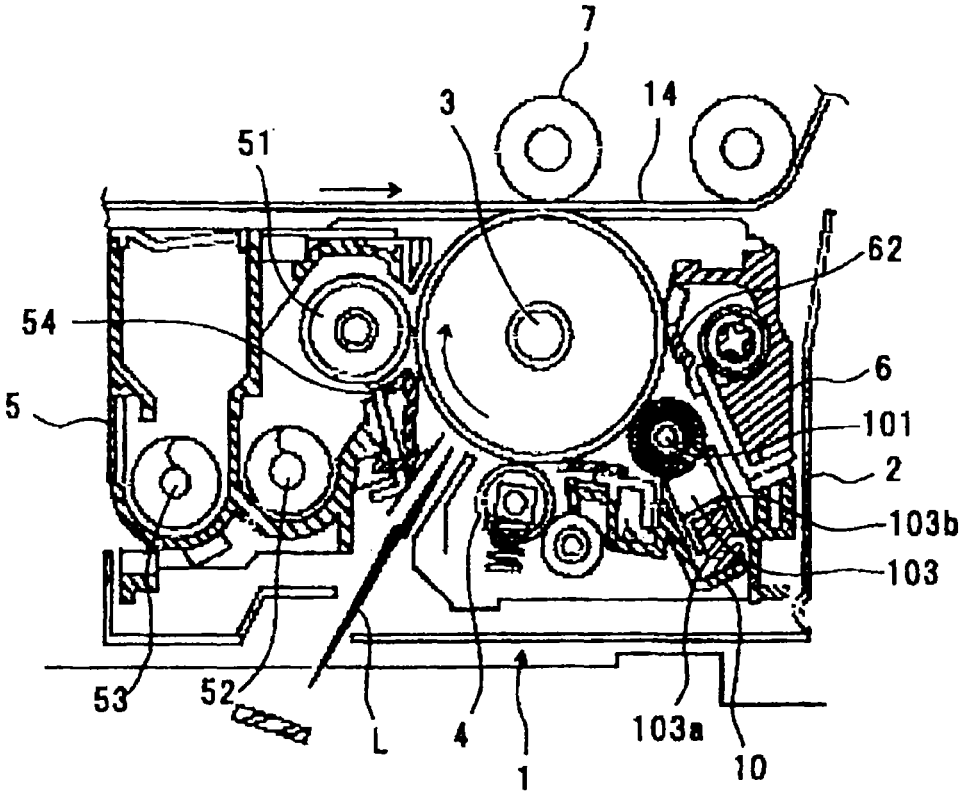
FIG. 2 is a schematic configuration diagram illustrating the image forming unit of FIG. 1.

FIG. 2 illustrates an image forming unit 1.

The image forming unit 1 is equipped with an image bearing member 3 in the form of a drum.

Note that, the image bearing member 3 may be in the form of a sheet or an endless belt.

In the surrounding area of the image bearing member 3, a charging roller 4, a developing device 5, a primary transfer roller 7, a cleaning device 6, a lubricant coating device 10, and a diselectrification lamp (not illustrated) are provided.

The charging roller 4 is a charging member provided in a charging device.

The developing device 5 is configured to develop the electrostatic latent image forming on the surface of the image bearing member 3 with a toner, to thereby form a toner image.

The primary transfer roller 7 is a primary transfer member provided to a primary transfer device configured to transfer a toner image formed on a surface of the image bearing member 3 to the intermediate transfer belt 14.

The cleaning device 6 is configured to clean the toner remained on the surface of the image bearing member 3, from which the toner image has been transferred onto the intermediate transfer belt 14.

The lubricant coating device 10 is configured to apply a lubricant to the surface of the image bearing member 3, which has been cleaned.

The diselectrification lamp (not illustrated) is configured to discharge the surface potential of the cleaned image bearing member 3.

The charging roller 4 is provided in a non-contact manner with the predetermined distance to the image bearing member 3, and is configured to charge the image bearing member 3 to the predetermined polarity and the predetermined potential. Laser light L is applied from the exposure unit 40 to the surface of the image bearing member 3, which has been uniformly charged by the charging roller 4, based on image information, to thereby form an electrostatic latent image.

The developing device 5 contains a developing roller 51. To the developing roller 51, developing bias is applied from a power source (not illustrated). In a casing of the developing device 5, provided are a supply screw 52 and a stirring screw 53, which are configured to stir a developer housed in the casing, while transporting in the mutually different direction. Moreover, also provided is a doctor 54 configured to regulate the developer held on the developing roller 51. The toner in the developer stirred and transported by the supply screw 52 and the stirring screw 53 is charged to the predetermined polarity. The developer is then scooped on a surface of the developing roller 51, the scooped developer is regulated by the doctor 54, and the toner is deposited on an electrostatic latent image formed on a surface of the image bearing member 3 in the developing region facing to the image bearing member 3.

The cleaning device 6 contains a cleaning blade 62. The cleaning blade 62 is brought into contact with the image bearing member 3 in the counter direction relative to the traveling direction of the surface of the image bearing member 3.

The press force of the cleaning blade 62 to the surface of the image bearing member 3 is typically 10 N/m to 100 N/m, preferably 10 N/m to 50 N/m. When the press force of the cleaning blade 62 to the surface of the image bearing member 3 is 10 N/m or greater, a cleaning failure, which is caused by passing a toner through a contact area between the cleaning blade 62 and the image bearing member 3, can be prevented. When the press force of the cleaning blade 62 to the surface of the image bearing member 3 is 100 N/m less, frictions at the contact area between the cleaning blade 62 and the image bearing member 3 are reduced, and therefore roll-up of the cleaning blade 62 can be prevented.

Note that, the press force of the cleaning blade 62 to the surface of the image bearing member 3 can be measured by means of a measuring device, in which a compact compression load cell (manufactured by Kyowa Electronic Instruments Co.) is mounted.

The lubricant coating device 10 is equipped with a solid lubricant 103 and a lubricant press spring 103*a*, and is further equipped with a fur brush 101 configured to apply the solid lubricant 103 to a surface of the image bearing member 3. The solid lubricant 103 is held by a bracket 103*b*, and is pressed to the side of the fur brush 101 by the lubricant press spring 103*a*. Then, the solid lubricant 103 is scraped with the fur brush 101, which rotates in the dragging direction relative to the rotational direction of the image bearing member 3, and the scraped lubricant is applied to the surface of the image bearing member 3. As a result, the friction coefficient of the surface of the image bearing member 3 is maintained to 0.2 or less, when an image is not formed.

Note that, the charging device is that of a non-contact adjacent setting type, where the charging roller 4 is provided adjacent to the image bearing member 3. However, the charging device may be corotron, scorotron, or a solid state charger.

A light source of laser light L of the exposure unit 40 and a light source of the diselectrification lamp are not particularly limited, and examples thereof include a fluorescent lamp, a tungsten lamp, a halogen lamp, a mercury lamp, a sodium lamp, a light-emitting diode (LED), a laser diode (LD), and an electroluminescent (EL) lamp. Among them, preferred are a laser diode (LD), and a light-emitting diode (LED), because they can apply light having a wavelength of 600 nm to 800 nm.

A filter may be used in combination with the exposure unit in order to apply only light having the desired wavelength range.

The filter is not particularly limited, and examples thereof include a sharp-cut filter, a band filter, a near infrared-cut filter, a dichroic filter, an interference filter, and a color temperature conversion filter.

The transfer unit 60 is equipped with an intermediate transfer belt 14, a cleaning unit 162, a first bracket 63, and a second bracket 64. Moreover, the transfer unit 60 is further equipped with primary transfer rollers 7Y, 7C, 7M, 7K, a secondary transfer back-up roller 66, a driving roller 67, a support roller 68, and a tension roller 69.

The intermediate transfer belt 14 rotates in an anticlockwise direction in the drawing by the rotational driving of the driving roller 67, while supported by the primary transfer rollers 7Y, 7C, 7M, 7K, the secondary transfer back-up roller 66, the driving roller 67, the support roller 68, and the tension roller 69. The primary transfer rollers 7Y, 7C, 7M, 7K nip the intermediate transfer belt 14 with the image bearing members 3Y, 3C, 3M, 3K, respectively, to thereby form primary transfer nips, respectively. Then, a transfer bias having an opposite polarity to that of the toner is applied to the back surface of the intermediate transfer belt 14 (the internal perimeter surface of the loop). In the process that the intermediate transfer belt 14 successively passes through the primary transfer nips, the toner images formed on the surfaces of the image bearing members 3Y, 3C, 3M, 3K are superimposed on the surface of the intermediate transfer belt 14 (the outer perimeter surface of the loop) to thereby perform primary transfer. As a result, the toner image (superimposed toner images) is formed on the surface of the intermediate transfer belt 14.

The secondary transfer back-up roller 66 nips the intermediate transfer belt 14 with the secondary transfer roller 70 provided at the outer side of the loop of the intermediate transfer belt 14, to thereby form a secondary transfer nip. A pair of registration rollers 55 sends a recording medium P, which has been nipped between the pair of the registration rollers 55, to the secondary transfer nip at timing to synchronize to the toner image formed on the surface of the intermediate transfer belt 14. The toner image formed on the surface of the intermediate transfer belt 14 is secondary transferred to the recording medium P in the secondary transfer nip by influences of a secondary transfer electric field formed between the secondary transfer roller 70 and the secondary transfer back-up roller 66, to which secondary transfer bias is applied, or nip pressure.

The toner, which has not been transferred to the recording medium P, is deposited on the intermediate transfer belt 14, which has passed through the secondary transfer nip. Therefore, the intermediate transfer belt 14 is cleaned by the cleaning unit 162. Note that, the cleaning unit 162 contains a cleaning blade 162*a* that is brought into contact with the surface of the intermediate transfer belt 14 (the outer perimeter surface of the loop) to scrape and remove the toner remained on the intermediate transfer belt 14.

The first bracket 63 is rocked at the predetermined rotational angle by on-off driving of a solenoid (not illustrated) with the rotational axis of the support roller 68 as a center. In the case where the 500 forms a monochromic image, the first bracket 63 is rotated only a little in an anticlockwise direction in the drawing by the driving of the solenoid. Specifically, the intermediate transfer belt 14 is separated from the image bearing members 3Y, 3C, 3M by rotating the primary transfer rollers 7Y, 7C, 7M in the anticlockwise direction in the drawing with the rotational axis of the support roller 68 being a center. Then, a monochromic image is formed by driving only the image forming unit 1K. As a result, consumptions of other members, which will be caused by driving the image forming units 1Y, 1C, 1M, can be avoided, when a monochromic image is formed.

The fixing unit 80 is provided at the upper side of the secondary transfer nip in the drawing. The fixing unit 80 is equipped with a press heat roller 81, which includes therein a heat source, such as a halogen lamp, and a fixing belt unit 82. The fixing belt unit 82 has a fixing belt 84, a heat roller 83, which includes therein a heat source, such as a halogen lamp, a tension roller 85, a driving roller 86, and a temperature sensor (not illustrated). The fixing belt 84 travels in an anticlockwise direction in the drawing, with supported by the heat roller 83, the tension roller 85, and the driving roller 86.

In this process, the fixing belt 84 is heated from the side of the back surface (the internal perimeter surface of the loop) by the heat roller 83. The press heat roller 81, which is rotationally driven in the clockwise direction in the drawing, is brought into contact with the surface of the fixing belt 84 (the outer perimeter surface of the loop) at the position where the fixing belt 84 is supported by the heat roller 83. As a result, a fixing nip, at which the press heat roller 81 and the fixing belt 84 are brought into contact with each other, is formed.

The temperature sensor (not illustrated) is provided at the outer side of the loop of the fixing belt 84 in the manner that, the temperature sensor faces to the surface of the fixing belt 84 (the outer perimeter of the loop) with the predetermined space, and the temperature sensor detects the surface temperature of the fixing belt 84 just before entering the fixing nip. The detected result is sent to the fixing power source circuit (not illustrated). The fixing power source circuit controls, with on-off, a heat source included in the heat roller 83, or a heat source included in the press heat roller 81, based on the detected result of the temperature sensor.

During this operation, the surface temperature of the fixing belt is typically 80° C. to 200° C.

Meanwhile, the recording medium P passed through the secondary transfer nip P is separated from the intermediate transfer belt 14, followed by sending the recording medium P into the fixing unit 80. The recording medium P is then nipped at the fixing nip in the fixing unit 80 to be transported from the bottom side to the upper side in the drawing. In this process, the recording medium P is heated, as well as pressed by the fixing belt 84, to thereby fix the toner image onto the recording medium P.

The recording medium P, to which the toner is fixed, is passed through a pair of discharge rollers 87, and is then discharged outside the apparatus. A stacking unit 88 is formed on the top surface of the housing of the main body of the image forming apparatus 500. The recording media P discharged outside the apparatus by the pair of the discharge rollers 87 are sequentially stacked in the stacking unit 88.

Toner cartridges 100Y, 100C, 100M, 100K, each configured to house therein a toner, are provided above the transfer unit 60. The toners in the toner cartridges 100Y, 100C, 100M, 100K are appropriately supplied to the developing devices 5Y, 5C, 5M, 5K, respectively. The toner cartridges 100Y, 100C, 100M, 100K are mounted independently to the image forming units 1Y, 1C, 1M, 1K, and can be detachably mounted in the main body of the image forming apparatus 500.

<Operations of Image Formation>

Next, image forming operations performed with the image forming apparatus 500 are explained.

Once a signal for a print execution from an operation unit (not illustrated) is received, first, the predetermined voltage or electric current is applied to the charging roller 4 and the developing roller 51 successively at the predetermined timings. Similarly, the predetermined voltage or electric current is applied to a light source of the exposure unit 40 and a light source of the diselectrification lamp successively at the predetermined timings. In the synchronized motions to this, the image bearing member 3 is rotationally driven in the direction shown with the arrow in the drawing by the driving motor (not illustrated).

Once the image bearing member 3 is rotated in the direction shown with the arrow in the drawing, a surface of the image bearing member 3 is uniformly charge to the predetermined potential by the charging roller 4. Then, laser light L is applied to the surface of the image bearing member 3 from the exposure unit 40 corresponding to the image information. As a result, the area of the surface of the image bearing member 3, to which the laser light L is applied, is discharged, to thereby form an electrostatic latent image.

The surface of the image bearing member 3, on which the electrostatic latent image has been formed, is rubbed by a magnetic brush that is composed of a developer formed on the developing roller 51 in the region facing to the developing device 5. In this operation, the charged toner on the developing roller 51 is transported to the side of the elastic latent image by the predetermined developing bias applied to the developing roller 51, to thereby develop the electrostatic latent image. The similar image forming process is performed in the image forming units 1Y, 1C, 1M, 1K, and the toner images of respective colors are formed on the surfaces of the image bearing members 3Y, 3C, 3M, 3K.

As mentioned above, the electrostatic latent image formed on the surface of the image bearing member 3 is reverse developed with the charged toner by the developing device 5 in the image forming apparatus 500.

Note that, an N/P (negative-positive) non-contact charging roller system where a toner is deposited on an area having the lower potential is explained above, but a system for use is not limited to the aforementioned system.

The toner images of respective colors formed on the surfaces of the image bearing members 3Y, 3C, 3M, 3K are sequentially primary transferred so that they are superimposed on a surface of the intermediate transfer belt 14. As a result, the toner image (superimposed toner images) is formed on the surface of the intermediate transfer belt 14.

The toner image formed on the surface of the intermediate transfer belt 14 is transferred to a recording medium P, which is fed from the first paper feeding cassette 151 or the second paper feeding cassette 152, and is fed to the secondary transfer nip with going through between the pair of the registration rollers 55. During this operation, the recording medium P is temporarily stopped with being nipped between the pair of the registration rollers 55, is synchronized with the edge of the image on the intermediate transfer belt 14, and is supplied to the secondary transfer nip. The recording medium P, to which the toner image has been transferred, is separated from the intermediate transfer belt 14, and is sent to the fixing unit 80. As the recording medium P, to which the toner image has been transferred, passes through the fixing unit 80, the toner image is fixed on the recording medium P by heat and pressure. The recording medium P, to which the toner image has been fixed, is discharged outside the image forming apparatus 500, and is stacked in the stacking unit 88.

Meanwhile, the toner remained on the surface of the intermediate transfer belt 14, from which the toner image has been transferred to the recording medium P at the secondary transfer nip, is removed by the cleaning unit 162.

Moreover, the toner remained on the surface of the image bearing member 3, from which the toner image has been transferred to the intermediate transfer belt 14 at the primary transfer nip, has been removed by the cleaning device 6. Thereafter, a lubricant is applied to the surface of the image bearing member 3 by the lubricant coating device 10, followed by discharging the surface thereof by the diselectrification lamp.

The image forming unit 1 is composed of the image bearing member 3, the charging roller 4 serving as a process unit, the developing device 5, the cleaning device 6, and the lubricant coating device 10, all of which are housed in a frame body 2. The image forming unit 1 is detachably mounted, as a process cartridge, in the main body of the image forming apparatus 500.

In the image forming apparatus 500, the image forming unit 1 has a configuration that the image bearing member 3 and process units are integratedly exchanged as a process cartridge. However, a configuration for use may be a configuration where the image bearing member 3, the charging roller 4, the developing device 5, the cleaning device 6, and the lubricant coating device 10 are individually exchanged per unit.

The recording medium P is not particularly limited, and examples thereof include plane paper, and a PET base for OHP.

Note that, the image forming apparatus is not particularly limited to that of an intermediate transfer system, and may be of a direct transfer system.

<Cleaning Blade>

Figure 3A:
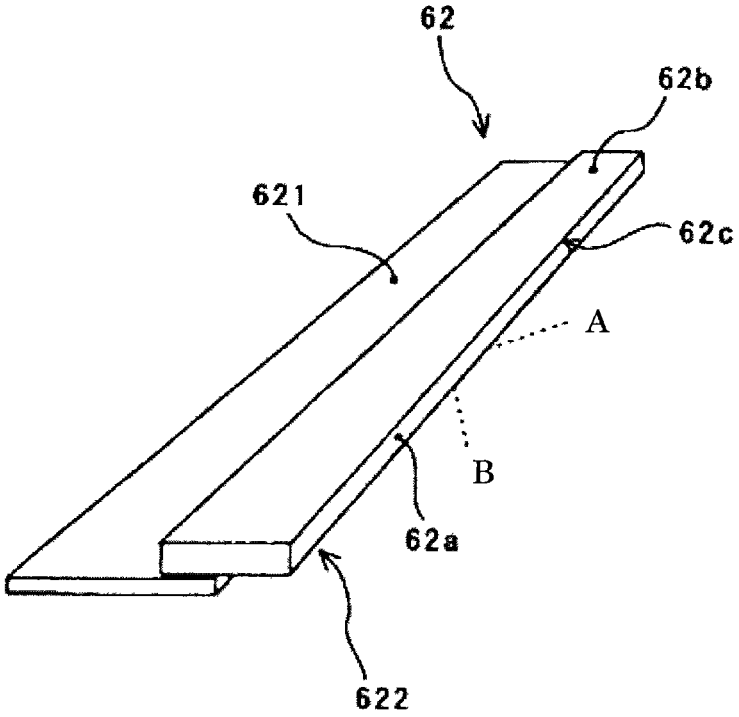
FIG. 3A is a perspective view illustrating the cleaning blade of FIG. 2.
Figure 3B:
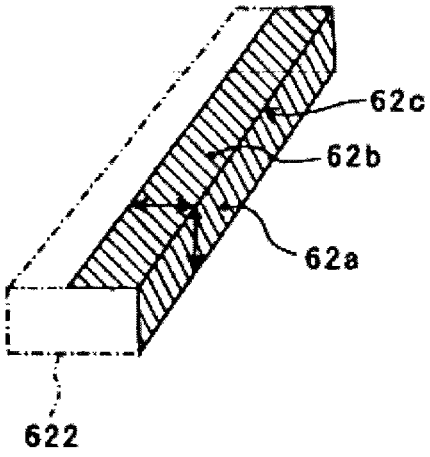
FIG. 3B is a partially enlarged view of a region of the cleaning blade of FIG. 3A, where the region is specified by dotted lines A and B in FIG. 3A.

FIG. 3A illustrates the cleaning blade 62.

The cleaning blade 62 is composed of a support member 621 of a flat plate, and an elastic member 622 of a flat plate. One end of the elastic member 622 is fixed to one end of the support member 621 with an adhesive, and another end of the support member 621 is cantilever supported by a case of the cleaning device 6.

Figure 4:
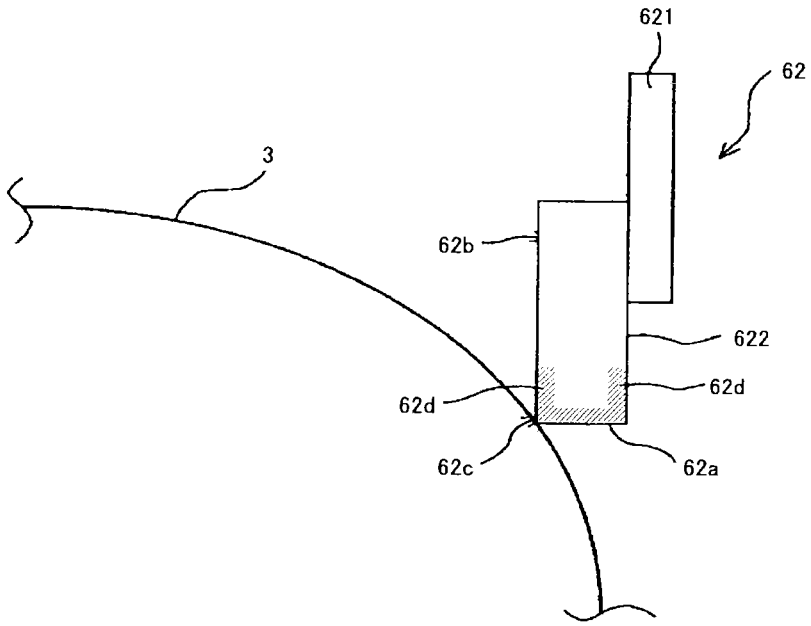
FIG. 4 is an enlarged cross-sectional view illustrating a state where the cleaning blade of FIG. 2 is in contact with a surface of the image bearing member.
Figure 5:
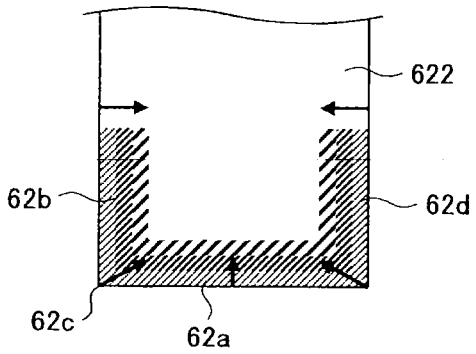
FIG. 5 is an enlarged view of an area adjacent to a contact part of the elastic member of FIG. 2.

The elastic member 622 is provided in a manner that the end ridge part 62*c*, which is a part where the bottom plane 62*b* of the elastic member 622 that is not fixed to the support member 621, and the edge plane 62*a* crosses, comes in contact with the surface of the image bearing member 3 along the longer direction (see FIG. 4).

The angle θ formed with a tangent line at the contact area between the cleaning blade 62 and the image bearing member 3, and the edge plane 62*a* of the cleaning blade is typically 65° to 85°. As the angle θ is 65° or greater, roll-up of the cleaning blade 62 can be prevented. As the angle θ is 85° or less, a cleaning failure can be prevented.

A material for constituting the support member 621 is not particularly limited, and examples thereof include a rigid material, such as a metal, a rigid plastic, and a ceramic. Among them, a metal is preferable, and stainless steel, aluminum, and phosphor bronze are more preferable, in view of the strength.

Note that, the support member 621 may be in the form of a strip or a sheet.

A material for constituting the elastic member 622 is not particularly limited, as long as the elastic member can track the eccentricity of the image bearing member 3, or minute waviness of the surface of the image bearing member 3, and examples thereof include polyurethane rubber, and polyurethane elastomer.

The elastic member 622 can be produced, for example, by synthesizing a polyurethane prepolymer using polyol and polyisocyanate, adding a curing agent (optionally with a curing catalyst), crosslinking and curing the mixture in the predetermined mold, performing post-crosslinking in a furnace, forming into a sheet through centrifugal forming, leaving the resultant to stand at room temperature to mature, and cutting into a flat plate of the predetermined size.

The polyol is not particularly limited, and examples thereof include high molecular weight polyol, and low molecular weight polyol. There may be used in combination.

Examples of the high molecular weight polyol include: polyester polyol, which is a condensate of alkylene glycol, and aliphatic diprotic acid; polyester polyol of alkylene glycol and adipic acid, such as ethylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone-based polyol, such as polycaprolactone ester polyol, which is a ring-opening polymer of caprolactone; and polyether-based polyol, such as poly(oxytetramethylene)glycol, and poly(oxypropylene)glycol.

Examples of the low molecular weight polyol include: dihydric alcohol, such as 1,4-butanediol, ethylene glycol, neopentyl glycol, hydroquinone bis(2-hydroxyethyl) ether, 3,3'-dichloro-4,4'-diaminodiphenylmethane, and 4,4'-diaminodiphenyl methane; and trihydric or higher alcohol, such as 1,1,1-trimethylol propane, glycerin, 1,2,6-hexanetriol, 1,2,4-butanetriol, trimethylol ethane, 1,1,1-tris(hydroxyethoxymethyl)propane, diglycerin, and pentaerythritol.

The polyisocyanate is not particularly limited, and examples thereof include methylene diphenyldiisocyanate (MDI), tolylene diisocyanate (TDI), xylylene diisocyanate (XDI), naphthylene-1,5-diisocyanate (NDI), tetramethylxylene diisocyanate (TMXDI), isophorone diisocyanate (IPDI), hydrogenated xylylene diisocyanate (H6XDI), dicyclohexylmethane diisocyanate (H12MDI), hexamethylene diisocyanate (HDI), dimmer acid diisocyanate (DDI), norbornene diisocyanate (NBDI), and trimethylhexamethylene diisocyanate (TMDI). These may be used in combination.

The curing catalyst is not particularly limited, and examples thereof include 2-methyl imidazole, and 1,2-dimethyl imidazole.

An amount of the curing catalyst added is typically 0.01% by mass to 0.5% by mass, and 0.05% by mass to 0.3% by mass.

The JIS-A hardness of the elastic member 622 is typically 60 degrees or greater, preferably 65 degrees to 80 degrees. When the JIS-A hardness of the elastic member 622 is 60 degrees or greater, a linear pressure of the blade can be easily attained, an area of the contact area with the image bearing member 3 does not tend to spread, and therefore a cleaning failure can be prevented.

The elastic member 622 is preferably a laminate in which two or more kinds of rubbers having mutually different JIS-A hardnesses are integrally formed, as abrasion resistance and trackability can be both attained.

The repulsion elasticity modulus of the elastic member 622 at 23° C. according to the standard of JIS K6255 is typically 35% or less, more preferably 20% to 30%. When the repulsion elasticity modulus of the elastic member 622 at 23° C. according to the standard of JIS K6255 is 35% or less, the elastic member 622 hardly generates tackiness, and a cleaning failure can be prevented.

The average thickness of the elastic member 622 is typically 1.0 mm to 3.0 mm.

Note that, the elastic member 622 may be in the form of a strip or a sheet.

In the elastic member 622, the composition containing the curing agent is cured in the end ridge part 62*c*.

A region 62*d* that is a cured composition containing a curing agent is formed by immersing the elastic member 622 in a coating material containing the composition and a solvent, followed by curing. As a result, the hardness of the end ridge part 62*c* of the elastic member 622 is improved, and therefore a durability of the elastic member 622 is improved, to thereby prevent cleaning failures.

The solvent is not particularly limited, and examples thereof include: a hydrocarbon-based solvent, such as toluene, and xylene; an ester-based solvent, such as ethyl acetate, n-butyl acetate, methyl cellosolve acetate, and propylene glycol monomethyl ether acetate; a ketone-based solvent, such as methyl ethyl ketone, methyl isobutyl ketone, diisobutyl ketone, cyclohexanone, and cyclopentanone; an ether-based solvent, such as ethylene glycol monomethyl ether, ethylene glycol monoethyl ether, and propylene glycol monomethyl ether; an alcohol-based solvent, such as ethanol, propanol, 1-butanol, isopropyl alcohol, and isobutyl alcohol. These may be used in combination.

The curing agent contains a polycyclic aliphatic hydrocarbon group, and a (meth)acryloyloxy group.

The curing agent can improve the hardness of the end ridge part 62*c*, as the curing agent contains a bulky polycyclic aliphatic hydrocarbon group.

The number of carbon atoms in the polycyclic aliphatic hydrocarbon group is typically 6 or greater, preferably 6 to 12, and more preferably 8 to 10. As the number of the carbon atoms in the alicyclic hydrocarbon group is 6 or greater, the hardness of the end ridge part 62*c* can be improved further.

The number of the (meth)acryloyloxy groups contained in the curing agent is typically 2 to 6, preferably 2 to 4. As the number of the (meth)acryloyloxy groups contained in the curing agent is 2 or greater, the hardness of the end ridge part 62*c* can be improved further. As the number of the (meth) acryloyloxy groups contained in the curing agent is 6 or less, steric hindrance can be prevented.

A molecular weight of the curing agent is typically 500 or smaller. Use of the curing agent having such a molecular weight enhance penetration ability thereof onto the elastic member 622, and therefore the hardness of the end ridge part 62*c* can be improved further.

The curing agent is preferably a derivative of tricyclodecane. Use thereof can further improve the hardness of the end ridge part 62*c*.

The tricyclodecane is not particularly limited, and examples thereof include tricyclo[5.2.1.0]decane, and adamantine (tricyclo[3.3.1.13,7]decane).

Specific examples of the curing agent include tricyclo [5.2.1.0]decane dimethanol di(meth)acrylate, 1,3-bis(meth) acryloyloxy adamantane, 1,3-adamantanedimethanol di(meth)acrylate, and 1,3,5-tris(meth)acryloyloxy adamantane.

An amount of the curing agent in the composition is typically 20% by mass to 100% by mass, preferably 50% by mass to 100% by mass. Use of the composition containing the curing agent in an amount of 20% by mass or greater can further improve the hardness of the end ridge part 62*c*.

Note that, whether or not the curing agent is contained in the end ridge part 62*c* can be analyzed by liquid chromatography. Whether or not the cured product of the curing agent is contained in the end ridge part 62*c*, moreover, can be analyzed by infrared spectroscopy.

The composition may further contain (meth)acrylate having a molecular weight of 100 to 1,500.

The (meth)acrylate having a molecular weight of 100 to 1,500 is not particularly limited, and examples thereof include dipentaerythritol hexa(meth)acrylate, pentaerythritol tetra(meth)acrylate, pentaerythritol tri(meth)acrylate, pentaerythritol ethoxy tetra(meth)acrylate, trimethylolpropane tri(meth)acrylate, trimethylolpropane ethoxy tri(meth)acrylate, 1,6-hexanediol di(meth)acrylate, ethoxylated bisphenol A di(meth)acrylate, propoxylated ethoxylated bisphenol A di(meth)acrylate, 1,4-butanediol di(meth)acrylate, 1,5-pentanediol di(meth)acrylate, 1,6-hexanediol di(meth)acrylate, 1,7-heptanediol di(meth)acrylate, 1,8-octanediol di(meth) acrylate, 1,9-nonanediol di(meth)acrylate, 1,10-decanediol di(meth)acrylate, 1,11-undecanediol di(meth)acrylate, 1,18-octadecanediol di(meth)acrylate, glycerin propoxy tri(meth) acrylate, dipropylene glycol di(meth)acrylate, tripropylene glycol di(meth)acrylate, PO-modified neopentyl glycol di(meth)acrylate, PEG600 di(meth)acrylate, PEG400 di(meth)acrylate, PEG200 di(meth)acrylate, neopentyl glycol.hydroxypivalic acid ester di(meth)acrylate, octyl/decyl (meth)acrylate, isobornyl(meth)acrylate, ethoxylated phenyl (meth)acrylate, and 9,9-bis[4-(2-(meth)acryloyloxyethoxy) phenyl]fluorene. These may be used in combination. Among them, pentaerythritol acrylate having 3 to 6 acryloyloxy groups is preferable.

Examples of the pentaerythritol acrylate containing 3 to 6 acryloyloxy group include pentaerythritol triacrylate, and dipentaerythritol hexaacrylate.

The composition may further contain a photoinitiator, and a polymerization inhibitor.

The photoinitiator is not particularly limited, and examples thereof include a photoradical polymerization initiator, and a photocation polymerization initiator. These may be used in combination. Among them, a photoradical polymerization initiator is preferable.

Examples of the photoradical polymerization initiator include aromatic ketone, acryl phosphone oxide, aromatic onium salt, organic peroxide, a thio compound (e.g., thioxanthone, and a compound containing a thiophenyl group), hexaaryl biimidazole, ketoxime, borate, azinium, metallocene, active ester, a compound containing a carbon-halogen bond, and alkyl amine.

Examples of the photoradical polymerization initiator include acetophenone, acetophenone benzylketal, 1-hydroxycyclohexylphenylketone, 2,2-dimethoxy-2-phenylacetophenone, xanthone, fluorenone benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyldimethyl ketal, 1-(4-isopropylphenyl)-2-hydroxy-2-methylpropan-1-one, 2-hydroxy-2-methyl-1-phenylpropan-1-one, thioxanthone, diethyl thioxanthone, 2-isopropylthioxanthone, 2-chlorothioxanthone, 2-methyl-1-[4-(methylthio)phenyl]-2-morpholinopropan-1-one, bis(2,4,6-trimethylbenzoyn-phenylphosphone oxide, 2,4,6-trimethylbenzoyldiphenylphosphone oxide, 2,4-diethyl thioxanthone, and bis(2,6-dimethoxybenzoyl)-2,4,4-trimethylpentylphosphone oxide.

Examples of a commercial product of the photoradical polymerization initiator include: IRGACURE 651, IRGACURE 184, DAROCUR 1173, IRGACURE 2959, IRGACURE 127, IRGACURE 907, IRGACURE 369, IRGACURE 379, DAROCUR TPO, IRGACURE 819, IRGACURE 784, IRGACURE OXE 01, IRGACURE OXE 02, and IRGACURE 754 (all manufactured by BASF); Speedcure TPO (manufactured by Lambson Ltd.); KAYACURE DETX-S (manufactured by Nippon Kayaku Co., Ltd.); Lucirin TPO, LR8893, and LR8970 (all manufactured by BASF); and Ubecryl P36 (manufactured by UCB).

An amount of the photoinitiator in the composition is typically 1% by mass to 20% by mass.

The polymerization inhibitor is not particularly limited, and examples thereof include: a phenol compound, such as p-methoxyphenol, cresol, t-butylcatechol, di-t-butylparacresol, hydroquinone monomethyl ether, α-naphthol, 3,5-di-t-butyl-4-hydroxytoluene, 2,2'-methylenebis(4-methyl-6-t-butylphenol), 2,2'-methylenebis(4-ethyl-6-butylphenol), and 4,4'-thiobis(3-methyl-6-t-butylphenol); a quinine compound, such as p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butylhydroquinone, mono-t-butylhydroquinone, monomethylhydroquinone, and 2,5-di-t-amylhydroquinone; amine, such as phenyl-β-naphthylamine, p-benzylaminophenol, di-β-naphthyl paraphenylene diamine, dibenzylhydroxyl amine, phenylhydroxyl amine, and diethylhydroxyl amine; a nitro compound, such as dinitrobenzene, trinitrotoluene, and picric acid; an oxime compound, such as quinone dioxime, and cyclhexanone oxime; and a sulfur compound, such as phenothiazine. These may be used in combination.

Figure 6:
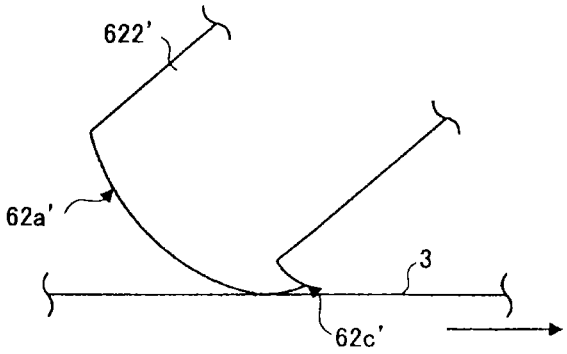
FIG. 6 Related Art
FIG. 6 is a diagram illustrating a state where an end ridge part of a conventional elastic member is rolled up.
Figure 7:
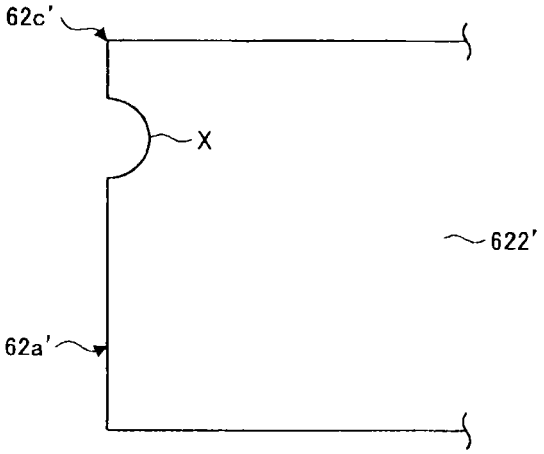
FIG. 7 Related Art
FIG. 7 is a diagram explaining local abrasion of an edge plane of a conventional elastic member.
Figure 8:
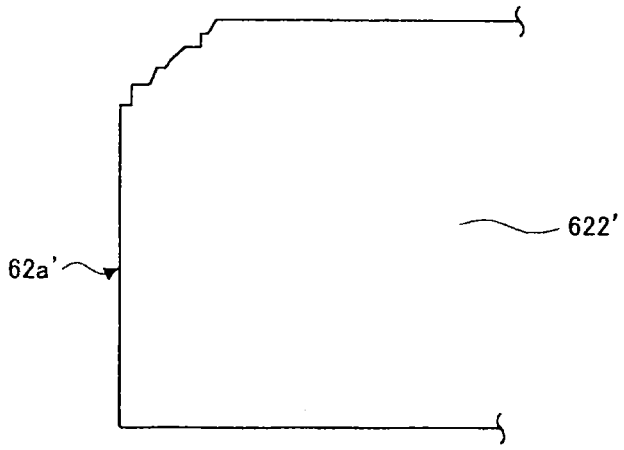
FIG. 8 Related Art
FIG. 8 is a diagram illustrating a state where an end ridge part of a conventional elastic member is fallen off.

When the elastic member 622', in which the composition containing the curing agent is not cured in the end ridge part 62*c*, is used, the friction force between the image bearing member 3 and the elastic member 622' becomes high, and therefore the elastic member 622' is pulled in the traveling direction of the image bearing member 3 to thereby roll up the end ridge part 62*c*' of the elastic member 622' (see FIG. 6). If the cleaning operation is continued with the state where the end ridge part 62*c*' of the elastic member 622' is rolled up, a local uneven abrasion X is caused at the position on edge plane 62*a*' of the elastic member 622', which is a several micrometers apart from the end ridge part 62*c*' (see FIG. 7). If the cleaning operation is further continued in this state, a size of the local uneven abrasion X is increased, and ultimately, the end ridge part 62*c*' is fallen off (see FIG. 8). If the, end ridge part 62*c*' is missing in the aforementioned manner, the toner cannot be cleaned regularly, to cause a cleaning failure.

<Image Bearing Member>

In the image bearing member 3, a photoconductive layer is formed on an electrically conductive support, and moreover a layer containing a binder resin and particles is formed on a surface thereof at the side where the photoconductive layer is formed. Therefore, adherence of foreign matter, such as a toner, and paper dusts, to a surface of the image bearing member 3 can be prevented. In this case of the image bearing member 3 having the aforementioned layer structure, fine vibrations are caused by the particles between the cleaning blade 62 and the image bearing member 3, adhesion of foreign matter can be prevented by bringing the cleaning blade 62 into contact with the image bearing member 3 at the predetermined pressure. Moreover, locally uneven abrasion of the image bearing member 3 can be prevented, and the image bearing member 3 can be effectively cleaned.

The binder resin is not particularly limited, and examples thereof include: a thermoplastic resin, such as polyacrylate, and polycarbonate; and a thermoset resin, such as a urethane resin, and a phenol resin. Among them, preferred are polyacrylate and polycarbonate, as use thereof can improve abrasion resistance of the surface layer 3*c*.

The particles may be organic particles or inorganic particles, but are preferably inorganic particles.

A material for constituting the organic particles is not particularly limited, and examples thereof include a fluororesin, and a crosslinked polymethyl methacrylate.

A material for constituting the inorganic particles is not particularly limited, and examples thereof include; a metal, such as copper, tin, aluminum, and indium; an oxide, such as silica, aluminum oxide, tin oxide, zinc oxide, titanium oxide, indium oxide, antimony oxide, bismuth oxide, antimony-doped tin oxide, and tin-doped indium oxide; and potassium titanate. Among them, an oxide is preferable, and aluminum oxide is more preferable.

As for the particles, two or more types thereof may be used in combination.

The inorganic particles may be surface-treated with a surface treating agent.

The surface treating agent is not particularly limited, and examples thereof include a titanate-based coupling agent, an aluminum-based coupling agent, a zircoaluminate-based coupling agent, and a silane coupling agent. These may be used in combination.

A surface treated amount of the inorganic particles with the surface treating agent is typically 3% by mass to 30% by mass, and preferably 5% by mass to 20% by mass.

It is preferred that the Martens hardness of the surface of the image bearing member 3 at the side where the photoconductive layer be formed is 190 $N/mm^2$ or greater, and the elastic work rate (We/Wt) of the surface of the image bearing member 3 at the side where the photoconductive layer is formed be 37.0% or greater. As Martens hardness of the surface of the image bearing member 3 at the side where the photoconductive layer is formed is 190 $N/mm^2$ or greater, adherence of a toner on the surface of the image bearing member 3 can be prevented. As the elastic work rate (We/Wt) of the surface of the image bearing member 3 where the photoconductive layer is formed is 37.0% or greater, abrasion unevenness due to a change in an abrasion speed can be prevented, in the case where an imaging area rate is changed in an axial direction of the image bearing member 3.

Therefore, the Martens hardness, and elastic work rate (We/Wt) of the surface of the image bearing member 3 at the side where the photoconductive layer is formed are controlled by an amount of the particles, or a type of the binder resin for use. Use of polycarbonate or polyacrylate as the binder resin can improve the Martens hardness, and elastic work rate (We/Wt) of the surface of the image bearing member 3 at the side where the photoconductive layer is formed can be improved, as the rigid structure can be incorporated into the resin skeleton. Moreover, use of a high molecular-weight charge transport material as the binder resin can improve the Martens hardness, and elastic work rate (We/Wt) of the surface of the image bearing member 3 at the side where the photoconductive layer is formed.

Figure 9:
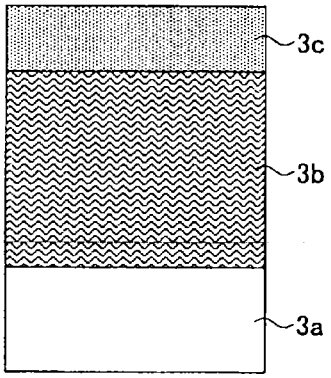
FIG. 9 is a cross-sectional view illustrating one example of a layer structure of the image bearing member of FIG. 2.

FIG. 9 illustrates one example of a layer structure of the image bearing member 3.

In the image bearing member 3, a photoconductive layer 3*b* and a surface layer 3*c* are sequentially laminated on an electrically conductive support 3*a*. The surface layer 3*c* contains a binder resin and particles.

Figure 10:
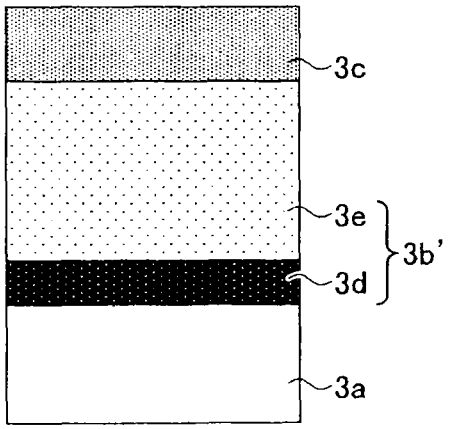
FIG. 10 is a cross-sectional view illustrating another example of a layer structure of the image bearing member of FIG. 2.

FIG. 10 illustrates another example of a layer structure of the image bearing member 3.

In the image bearing member 3, a photoconductive layer 3*b*', and a surface layer 3*c* are sequentially laminated on an electrically conductive support 3*a*. In the photoconductive layer 3*b*', a charge generation layer 3*d*, and a charge transport layer 3*e* are sequentially laminated. The surface layer 3*c* contains a binder resin, and particles.

Figure 11:
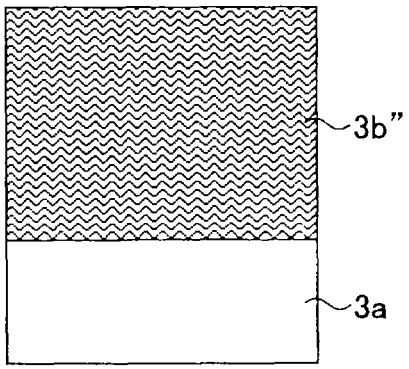
FIG. 11 is a cross-sectional view illustrating yet another example of a layer structure of the image bearing member of FIG. 2.

FIG. 11 illustrates yet another example of the image bearing member 3.

In the image bearing member 3, a photoconductive layer 3*b*" is formed on an electrically conductive support 3*a*. The photoconductive layer 3*b*" contains a binder resin, and particles.

Note that, a layer structure of the image bearing member 3 is not particularly limited.

The electrically conductive support 3*a* is not particularly limited, as long as the volume resistivity thereof is $1\times10^{10}$ Ω·cm or lower, and examples thereof include: a film or cylinder-shaped plastic or paper coated with a metal (e.g., aluminum, nickel, chromium, nichrome, copper, gold, silver, and platinum) or a metal oxide (e.g., tin oxide, and indium oxide) through vacuum deposition or sputtering; and a tube formed by forming a plate of aluminum, aluminum alloy, nickel, or stainless steel, or an element tube of aluminum, aluminum alloy, nickel, or stainless steel, by a method, such as extrusion, and drawing, followed by cutting and a surface treatment, such as super finishing, and polishing.

An electrically conductive layer, in which an electrically conductive powder is dispersed in a binder resin, may be formed on the support.

The electrically conductive powder is not particularly limited, and examples thereof include: carbon black; acetylene black; a powder of a metal, such as aluminum, nickel, iron, nichrome, copper, zinc, and silver; and a powder of a metal oxide, such as electrically conductive tin oxide, and ITO.

Examples of the binder resin include polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyacrylate, a phenoxy resin, polycarbonate, a cellulose acetate resin, an ethyl cellulose resin, polyvinyl butyral, polyvinyl formal, polyvinyl toluene, poly(N-vinylcarbazole), an acryl resin, a silicone resin, an epoxy resin, a melamine resin, a urethane resin, a phenol resin, and an alkyd resin.

The electrically conductive layer can be formed by applying a coating liquid, in which a composition containing an electrically conductive powder and a binder resin is dissolved or dispersed in a solvent, followed by drying the coating liquid.

The solvent is not particularly limited, and examples thereof include tetrahydrofuran, dichloromethane, methyl ethyl ketone, and toluene.

As for the electrically conductive support 3*a*, a cylindrical support, on which an electrically conductive layer is formed using a heat-shrinkable tube, in which electrically conductive powder is dispersed in a resin, can be used.

The resin is not particularly limited, and examples thereof include polyvinyl chloride, polypropylene, polyester, polystyrene, polyvinylidene chloride, polyethylene, chlorinated rubber, and Teflon (registered trade mark).

Next, the photoconductive layer 3*b*' is explained.

The charge generation layer 3*d* contains a charge generation material.

The charge generation material is not particularly limited, and examples thereof include a monoazo pigment, a bisazo pigment, a trisazo pigment, a perylene-based pigment, a perinone-based pigment, a quinacridon-based pigment, a quinine-based condensed polycyclic compound, a squaric acid-based dye, a phthalocyanine-based pigment, a naphthalocyanine-based pigment, and an azulenium salt-based dye. These may be used in combination. Among them, an azo pigment and/or a phthalocyanine-based pigment are preferable.

The charge generation layer 3*d* may further contain a binder resin.

The binder resin is not particularly limited, and examples thereof include plyamide, polyurethane, epoxy resin, polyketone, polycarbonate, a silicone resin, an acryl resin, polyvinyl butyral, polyvinyl formal, polyvinyl ketone, polystyrene, polysulfone, poly(N-vinylcarbazole), polyacryl amide, polyvinyl benzale, polyester, a phenoxy resin, a vinyl chloride-vinyl acetate copolymer, polyvinyl acetate, polyphenylene oxide, polyamide, polyvinyl pyridine, a cellulose-based resin, casein, polyvinyl alcohol, and polyvinyl pyrrolidone.

A mass ratio of the binder resin to the charge generation material is typically 0 to 5, preferably 0.1 to 3.

The charge generation layer 3*d* can be formed by applying a coating liquid, in which a composition containing a charge generation material, and a binder resin is dissolved or dispersed in a solvent, followed by drying the coating liquid.

The solvent is not particularly limited, and examples thereof include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and logroin. Among them, preferred are a ketone-based solvent, an ester-based solvent, and an ether-based solvent.

At the time when the composition containing the charge generation material and the binder resin is dissolved or dispersed in the solvent, a ball mill, Attritor, a sand mill, or ultrasonic waves may be used.

The application method of the coating liquid is not particularly limited, and examples thereof include dip coating, spray coating, bead coating, nozzle coating, spinner coating, and ring coating.

A thickness of the charge generation layer 3*d* is typically about 0.01 μm to about 5 μm, preferably 0.1 μm to 2 μm.

The charge transport layer 3*e* contains a charge transport material, and a binder resin.

As for the charge transport material, a hole transport material, and an electron transport material.

The charge transport material is not particularly limited, and examples thereof include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrobenzothiophen-5,5-dioxide, and a benzoquinone derivative. These may be used in combination.

The hole transport material is not particularly limited, and examples thereof include poly(N-vinylcarbazole) and a derivative thereof, poly(γ-carbazolylethylglutamate) and a derivative thereof, a pyrene-formaldehyde condensate and a derivative thereof, polyvinyl pyrene, polyvinyl phenanthrene, polysilane, a derivative of oxazole, a derivative of oxadiazole, a derivative of imidazole, a derivative of monoaryl amine, a derivative of diaryl amine, a derivative of triaryl amine, a derivative of stilbene, a derivative of α-phenylstilbene, a derivative of benzidine, a derivative of diaryl methane, a derivative of triaryl methane, a derivative of 9-styrylanthracene, a derivative of pyrazoline, a derivative of divinyl benzene, a derivative of hydrazone, a derivative of indene, a derivative of butadiene, a derivative of pyrene, a derivative of bisstilbene, and a derivative of enamine. These may be used in combination.

The binder resin is not particularly limited, and examples thereof include polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyacrylate, a phenoxy resin, polycarbonate, a cellulose acetate resin, an ethyl cellulose resin, polyvinyl butyral, polyvinyl formal, polyvinyl toluene, poly (N-vinylcarbazole), an acryl resin, a silicone resin, an epoxy resin, a melamine resin, a urethane resin, a phenol resin, and an alkyd resin.

A mass ratio of the charge transport material to the binder resin is typically 0.2 to 3, preferably 0.4 to 1.5.

The charge transport layer 3*e* may further contain a plasticizer, a leveling agent, and an antioxidant.

Examples of the plasticizer include dibutyl phthalate, and dioctyl phthalate.

A mass ratio of the plasticizer to the binder resin is typically about 0 to about 0.3.

The leveling agent is not particularly limited, and examples thereof include: silicone oil, such as dimethylsilicone oil, and methylphenylsilicone oil; and a polymer or oligomer containing a perfluoroalkyl group at a side chain thereof.

A mass ratio of the leveling agent to the binder resin is typically 0 to 0.01.

A thickness of the charge transport layer 3*e* is typically 5 μm to 25 μm.

The charge transport layer 3*e* can be formed by applying a coating liquid, in which a composition containing a charge transport material, and a binder resin is dissolved or dispersed in a solvent, followed by drying the coating liquid.

The solvent is not particularly limited, and examples thereof include tetrahydrofuran, dioxane, toluene, dichloromethane, monochlorobenzene, dichloroethane, cyclohexanone, methyl ethyl ketone, and acetone.

Note that, in the layer structure depicted in FIG. 10, a charge transport layer 3*e* containing a binder resin and particles may be formed without forming the surface layer 3*c*.

In this case, an amount of the particles in the charge transport layer 3*e* is typically 3% by mass to 30% by mass, preferably 3% by mass to 20% by mass. When the amount of the particles in the charge transport layer 3*e* is 3% by mass or greater, abrasion of the image bearing member 3, which includes uneven abrasion, and adherence of foreign matter to a surface of the image bearing member 3 can be prevented. When the amount of the particles in the charge transport layer 3*e* is 30% by mass or less, an increase in residual potential, and reduction in transmittance of writing light to the charge transport layer 3*e* can be prevented.

Next, the photoconductive layer 3*b* is explained.

The photoconductive layer 3*b* contains a charge generation material, a charge transport material, and a binder resin.

As for the binder resin, a binder resin identical to the binder resin for use in the charge transport layer 3*e* can be used. The same binder resin to that of the charge generation layer 3*d* may be also used as the binder resin in the photoconductive layer 3*b*.

The photoconductive layer 3*b* may further contain a plasticizer, a leveling agent, and an antioxidant.

A thickness of the photoconductive layer 3*b* is typically about 5 μm to about 25 μm.

The photoconductive layer 3*b* can be formed by applying a coating liquid, in which a composition containing a charge generation material, a charge transport material, and a binder resin are dissolved or dispersed in a solvent, followed by drying the coating liquid.

The solvent is not particularly limited, and examples thereof include tetrahydrofuran, dioxane, dichloroethane, and cyclohexanone.

The application method of the coating liquid is not particularly limited, and examples thereof include dip coating, spray coating, and bead coating.

Next, the photoconductive layer 3*b*" is explained.

The photoconductive layer 3*b*" has the same structure to that of the photoconductive layer 3*b*, provided that the photoconductive layer 3*b*" contains a binder resin and particles.

An amount of the particles in the surface layer 3*c* is typically 5% by mass to 50% by mass, preferably 5% by mass to 30% by mass. When the amount of the particles in the surface layer 3*c* is 5% by mass or greater, abrasion of the image bearing member 3, which includes uneven abrasion, and adherence of foreign matter to a surface of the image bearing member 3 can be prevented. When the amount of the particles in the surface layer 3*c* is 50% by mass or less, an increase in residual potential, and reduction in transmittance of writing light to the surface layer 3*c* can be prevented.

A thickness of the surface layer 3*c* is typically 1.0 μm to 8.0 μm.

The surface layer 3*c* can be formed by applying a coating liquid, in which a composition containing a binder resin and particles are dissolved or dispersed in a solvent, followed by drying the coating liquid.

The solvent is not particularly limited, and examples thereof include tetrahydrofuran, dioxane, toluene, dichloromethane, monochlorobenzene, dichloroethane, cyclohexanone, and methyl ethyl ketone, acetone.

The application method of the coating liquid is not particularly limited, and examples thereof include dip coating, ring coating, and spray coating. Among them, spray coating is preferable.

The surface layer 3*c* may further contain the below-mentioned charge transport material for the purpose of reducing residual potential, and improving response of a resulting image bearing member.

In the case where a low molecular weight charge transport material is used as the charge transport material, a concentration gradient of the charge transport material may be provided in the surface layer 3*c*.

Moreover, a high molecular weight charge transport material may be used as the charge transport material. Use of the high molecular weight charge transport material can improve abrasion resistance of the surface layer 3*c*.

The high molecular weight charge transport material is not particularly limited, and examples thereof include derivatives of polycarbonate, polyurethane, polyester, and polyether. Among them, preferred is polycarbonate having a triarylamine structure.

An undercoat layer may be further formed between the electrically conductive support 3*a* and the photoconductive layer 3*b* or 3*b*'.

The undercoat layer contains a resin.

The resin is not particularly limited, provided that it has high resistance to a coating liquid that is applied when the photoconductive layer 3*b* or 3*b*' is formed. Examples thereof include: a water-soluble resin, such as polyvinyl alcohol, casein, and sodium polyacrylate; an alcohol-soluble resin, such as copolymer nylon, and methoxy methylated nylon; and a thermoset resin, such as polyurethane, a melamine resin, a phenol resin, an alkyd-melamine resin, and an epoxy resin.

The undercoat layer may further contain metal oxide particles to prevent interference fringes, and to reduce residual potential.

The metal oxide is not particularly limited, and examples thereof include titanium oxide, silica, alumina, zirconium oxide, thin oxide, and indium oxide.

The undercoat layer can be formed by applying a coating liquid, in which a resin is dissolved or dispersed in a solvent, followed by drying the coating liquid.

Other than the formation method of the undercoat layer mentioned above, examples of the formation method thereof include: a method where a surface treatment is performed using a silane coupling agent, a titanium coupling agent, or a chromium coupling agent; a method where the electrically conductive support 3*a* formed aluminum is anoded; and a method where a thin film of an organic material (e.g., polyparaxylylene (parylene)) or an inorganic material ($SiO_2$, $SnO_2$, $TiO_2$, ITO, and $CeO_2$) is formed by a vacuum thin film forming technique.

A thickness of the undercoat layer is typically 5 μm or less.

<Developer>

Next, a developer for use in the developing device 5 is explained.

The developer may be a one-component developer composed of a toner, or a two-component developer composed of a toner, and a carrier.

The toner contains base particles, and external additives, and may be a monochrome toner, or a color toner.

The base particles each contain a binder resin, and a colorant, and may further contain a releasing agent, and a charge controlling agent, according to the necessity.

The binder resin is not particularly limited, and examples thereof include: a homopolymer or styrene or a substituted product thereof, such as polystyrene, and polyvinyl toluene; a styrene copolymer, such as a styrene-p-chrolostyrene copolymer, a styrene-propylene copolymer, a styrene-vinyltoluene copolymer, a styrene-methyl acrylate copolymer, a styrene-ethyl acrylate copolymer, a styrene-butyl acrylate copolymer, a styrene-methyl methacrylate copolymer, a styrene-ethyl methacrylate copolymer, a styrene-butyl methacrylate copolymer, a styrene-methyl-α-chloromethacrylate copolymer, a styrene-acrylonitrile copolymer, a styrene-vinyl methyl ether copolymer, a styrene-vinyl methyl ketone copolymer, a styrene-butadiene copolymer, a styrene-isoprene copolymer, a styrene-maleic acid copolymer, and a styrene-maleic acid ester copolymer; polymethyl methacrylate; polybutyl methacrylate; polyvinyl chloride; polyvinyl acetate; polyethylene; polypropylene; polyester; polyurethane; an epoxy resin; polyvinyl butyral; polyacrylic acid; rosin modified rosin; a terpene resin; a phenol resin; an aliphatic hydrocarbon resin; and an aromatic petroleum resin. These may be used in combination.

Among them, polyester is preferable, as the polyester can lower melt viscosity of a resulting toner, while maintaining stability thereof during storage of the toner.

The polyester can be synthesized through polycondensation between an alcohol component and a carboxylic acid component.

The alcohol component is not particularly limited, and examples thereof include: diol, such as polyethylene glycol, diethylene glycol, triethylene glycol, 1,2-propylene glycol, 1,3-propylene glycol, 1,4-propylene glycol, neopentyl glycol, and 1,4-butenediol; etherificated bisphenol, such as 1,4-bis(hydroxymethyl)cyclohexane, bisphenol A, hydrogenated bisphenol A, polyoxyethylene ether of bisphenol A, and polyoxypropylene ether of bisphenol A; bihydric alcohol, such as those listed above substituted with C3-C22 saturated or unsaturated hydrocarbon groups; and trihydric or higher polyhydric alcohol monomer, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylol ethane, trimethylol propane, and 1,3,5-trihydroxymethylbenzene.

The carboxylic acid component is not particularly limited, and examples thereof include: monocarboxylic acid, such as palmitic acid, stearic acid, and oleic acid; divalent carboxylic acid, such as maleic acid, fumaric acid, mesaconic acid, citraconic acid, terephthalic acid, cyclohexane dicarboxylic acid, succinic acid, adipic acid, sebacic acid, malonic acid, and any of the aforementioned dicarboxylic acids substituted with a C3-C22 saturated or unsaturated hydrocarbon group; dimmer acid derived from linolenic acid; trivalent or higher polycarboxylic acid, such as 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 3,3-dicarboxymethylbutanoic acid, tetracarboxymethyl methane, and 1,2,7,8-octanetetracarboxylic acid, Empol trimer acid, and anhydrides thereof.

Note that, anhydride or lower alkyl ester of carboxylic acid can be used as the carboxylic acid component.

The colorant is not particularly limited, provided that it is a dye or a pigment. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. These may be used in combination.

An amount of the colorant in the toner is typically 1% by mass to 15% by mass, preferably 3% by mass to 10% by mass.

The colorant may be used as a master batch, in which the colorant forms a composite with a resin.

The resin is not particularly limited, and examples thereof include a polymer of styrene or substituted product thereof, a styrene-based copolymer, polymethyl methacrylate, polybutyl methacrylate, polyvinyl chloride, polyvinyl acetate, polyethylene, polypropylene, polyester, an epoxy resin, epoxy-polyol, polyurethane, polyamide, polyvinyl butyral, polyacrylic acid, rosin, modified rosin, a terpene resin, an aliphatic hydrocarbon resin, an alicyclic hydrocarbon resin, and an aromatic petroleum resin. These may be used in combination.

The releasing agent is not particularly limited, and examples thereof include wax containing a carbonyl group, polyolefin wax, and long-chain hydrocarbon. These may be used in combination. Among them, wax containing a carbonyl group is preferable.

Examples of the wax containing a carbonyl group include polyalkanoic acid ester, polyalkanol ester, polyalkanoic acid amide, polyalkyl amide, and dialkyl ketone. Among them, polyalkanoic acid ester is preferable.

Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate.

Examples of the polyalkanol ester include tristearyl trimellitate, and distearyl melate.

Examples of the polyalkanoic acid amide include dibehenyl amide.

Examples of the polyalkyl amide include trimellitic acid tristearyl amide.

Examples of the dialkyl ketone include distearyl ketone.

Examples of the polyolefin wax include polyethylene wax, and polypropylene wax.

Examples of the ling-chain hydrocarbon include paraffin wax, and Sasol Wax.

An amount of the releasing agent in the toner is typically 5% by mass to 15% by mass.

The charge controlling agent is not particularly limited, and examples thereof include a nigrosine-based dye, a triphenyl methane-based dye, a chrome-containing metal complex dye, a molybdic acid chelate pigment, a rhodamine-based dye, alkoxy amine, quaternary ammonium salt (including fluorine-modified quaternary ammonium salt), alkyl amide, phosphorus or a phosphorus compound, tungsten or a tungsten compound, a fluorosurfactant, a metal salt of salicylic acid, and a metal salt of a salicylic acid derivative.

An amount of the charge controlling agent in the toner is typically 0.1% by mass to 10% by mass, preferably 0.2% by mass to 5% by mass.

The external additives are not particularly limited, and examples thereof include a flow improving agent, a cleaning improving agent, and a magnetic material. These may be used in combination.

The flow improving agent is not particularly limited, and examples thereof include inorganic particles, such as silica particles, titanium oxide particles, alumina particles, silicon carbide particles, silicon nitride, and boron nitride.

The flow improving agent is preferably subjected to a hydrophobing treatment using a surface treating agent. Use of the flow improving agent, which has been subjected to the hydrophobing treatment can prevent reduction in flowability or charging ability under high humidity conditions.

The surface treating agent is not particularly limited, and examples thereof include a silane coupling agent, a sililation agent, a silane coupling agent containing a fluoroalkyl group, an organic titanate-based coupling agent, an aluminum-based coupling agent, silicone oil, and modified-silicone oil.

The flow improving agent is preferably silica particles, which has been subjected to a hydrophobing treatment using silicone oil.

Examples of the silicone oil include dimethyl silicone oil, methyl hydrogen silicone oil, and methyl phenyl silicone oil.

Examples of a commercial product of the silica particles hydrophobic treated with silicone oil include RY200, R2T200S, NY50, and RY50 (all manufactured by Nippon Aerosil Co., Ltd.).

The cleaning improving agent is not particularly limited, and examples thereof include: metal soap, such as zinc stearate, calcium stearate; and resin particles produced by soap-free emulsion polymerization, such as polymethyl methacrylate particles, and polystyrene particles.

The volume average particle diameter of the resin particles is typically 0.01 μm to 1 μm.

The magnetic material is not particularly limited and examples thereof include iron, magnetite, and ferrite.

A production method of the toner is not particularly limited, and examples thereof include a pulverization method, a polymerization method, a dissolution suspension method, and a spray atomizing method. Among them, a polymerization method is preferable in view of an improvement of image quality, as a toner of spherical shape and small diameters can be easily attained.

Next, the pulverization method is explained.

The pulverization method is a method, in which base particles are obtained by melt-kneading a composition containing a binder resin, and a colorant, pulverizing the kneaded product, followed by classifying the pulverized product.

A melt-kneader used at the time when the composition is melt-kneaded is not particularly limited, and examples thereof include a single or twin screw continuous kneader, and a batch-type kneader using a roll mill.

Examples of a commercial product of the melt-kneader include a KTK twin screw extruder (manufactured by KOBE STEEL, LTD.), a TEM extruder (manufactured by TOSHIBA MACHINE CO., LTD.), a twin screw extruder (miracle k.c.k, manufactured by ASADA IRON WORKS CO., LTD.), a PCM twin screw extruder (manufactured by Ikegai Corp.), and a cokneader (manufactured by Buss).

At the time of pulverizing the kneaded product, it is preferred that the kneaded product be coarsely pulverized, followed by finely pulverized.

The method for pulverizing the kneaded product is not particularly limited, and examples thereof include: a method, in which the kneaded product is pulverized by crushing the kneaded product into an impact board in a jet flow; a method, in which particles are crushed to each other in a jet flow to thereby pulverize the particles; and a method, in which the kneaded product is pulverized in a narrow gap between a rotor that is mechanically rotated, and a stator.

At the time when the pulverized product is classified, fine particles can be removed by means of a cyclone, a decanter, or centrifuge.

A toner can be produced by mixing the base particles and the external additives by means of a mixer.

Next, the polymerization method is explained.

The polymerization method is a method where a liquid, in which a composition containing a polyester prepolymer containing an isocyanate group, amine, and a colorant is dissolved or dispersed in an organic solvent, is dispersed in an aqueous medium, followed by removing the organic solvent, to thereby form base particles.

The polyester prepolymer containing an isocyanate group can be synthesized by allowing a hydroxyl group positioned at a terminal of polyester, and polyvalent isocyanate As a urea-modified polyester is generated by allowing the polyester prepolymer containing an isocyanate group and amine, offset resistance of a resulting toner can be improved, while maintaining low temperature fixing ability of the toner.

The polyvalent isocyanate is not particularly limited, and examples thereof include aliphatic polyvalent isocyanate (e.g., tetramethylene diisocyanate, hexamethylene diisocyanate, 2,6-diisocyanatomethyl caproate), alicyclic polyisocyanate (e.g., isophorone diisocyanate, and cyclohexylmethane diisocyanate), aromatic diisocyanate (e.g., tolylene diisocyanate, diphenylmethane diisocyanate), and aromatic aliphatic diisocyanate (e.g., α,α,α',α'-tetramethylxylylene diisocyanate). These may be used in combination.

A molar ratio [NCO]/[OH] of the isocyanate groups contained in the polyvalent isocyanate to the hydroxyl groups contained in the polyester is typically 1 to 5, preferably 1.2 to 4, and more preferably 1.5 to 2.5.

Note that, an isocyanate group of the polyvalent isocyanate may be blocked with a phenol derivative, oxime, or caprolactam.

The average value of the number of isocyanate groups contained in the polyester prepolymer containing an isocyanate group is typically 1 or greater, preferably 1.5 to 3, and more preferably 1.8 to 2.5.

The amine is not particularly limited, and examples thereof include divalent amine, trivalent or higher amine, amino alcohol, amino mercaptan, and amino acid. These may be used in combination. Among them, preferred is divalent amine, or a combination of divalent amine and a small amount of trivalent or higher amine.

Examples of the divalent amine include aromatic diamine (e.g., phenylene diamine, diethyltoluene diamine, 4,4'-diaminodiphenyl methane), alicyclic diamine (e.g., 4,4'-diamino-3,3'-dimethyldicyclohexylmethane, diamine cyclohexane, and isophorone diamine), and aliphatic diamine (e.g., ethylene diamine, tetramethylene diamine, and hexamethylene diamine).

Examples of the trivalent or higher amine include diethylene triamine, and triethylene tetramine.

Examples of the amino alcohol include ethanol amine, and hydroxyethyl aniline.

Examples of the aminomercaptan include aminoethylmercaptan, and aminopropylmercaptan.

Examples of the amino acid include aminopropionic acid, and aminocaproic acid.

A molar ratio [NCO]/[NHx] of the isocyanate groups contained in the polyester prepolymer to the amino groups contained in the amine is typically 0.5 to 2, preferably ⅔ to 1.5, and more preferably ⅚ to 1.2.

Note that, an amino group of the amine may be blocked with ketone (e.g., acetone, methyl ethyl ketone, and methyl isobutyl ketone).

A disperser used at the time when the composition is dissolved or dispersed in the organic solvent is not particularly limited, and examples thereof include a low-shearing disperser, a high-shearing disperser, a friction disperser, a high pressure jet disperser, and an ultrasonic disperser. Among them, a high-shearing disperser is preferable, as particle diameters of oil droplets can be controlled to the range of 2 μm to 20 μm.

The revolution number of the high-shearing disperser is typically 1,000 rpm to 30,000 rpm, preferably 5,000 rpm to 20,000 rpm.

The dispersion time of the high-shearing disperser is typically 0.5 minutes to 5 minutes in case of a batch system.

The dispersion temperature of the high-shearing disperser is typically 0° C. to 150° C. under the pressurized condition, preferably 40° C. to 98° C.

A mass ratio of the aqueous medium to the composition is typically 0.5 to 20, preferably 1 to 10.

A method for removing the organic solvent is not particularly limited, and examples thereof include: a method where temperature is gradually elevated to evaporate the organic solvent in the oil droplets; and a method where the dispersion liquid is sprayed in a dry atmosphere to remove the organic solvent in the oil droplets.

The base particles are typically dried after washed, but the base particles may be further subjected to classification.

The base particles may be classified by removing fine particles by means of a cyclone, a decanter, or a centrifuge separator, before drying. The base particles may be classified by removing coarse particles after drying.

The toner can be produced by mixing the base particles and the external additives, and optionally particles, such as a charge controlling agent. Detachment of the particles from surfaces of the base particles can be prevented by applying a mechanical impact during the mixing.

A method for applying the mechanical impact is not particularly limited, and examples thereof include: a method where an impact is applied to a mixture using a blade rotating at high speed; and a method where a mixture is introduced into a high-speed air flow to accelerate the speed to thereby crush the particles to each other, or crush the particles to a crush board.

The device for applying the mechanical impact is not particularly limited, and examples thereof include ANGMILL (manufactured by Hosokawa Micron Corporation), an apparatus produced by modifying I-type mill (manufactured by Nippon Pneumatic Mfg. Co., Ltd.) so that the pulverizing air pressure thereof is decreased, a hybridization system (manufactured by Nara Machinery Co., Ltd.), a kryptron system (manufactured by Kawasaki Heavy Industries, Ltd.) and an automatic mortar.

The average circularity of the toner is typically 0.97 or greater, preferably 0.97 to 0.98. As the average circularity of the toner is 0.97 or greater, the transfer ability of the toner is improved, to thereby improve image quality.

Note that, the average circularity of the toner can be measured by means of a flow particle image analyzer FPIA-1000 (manufactured by Sysmex Corporation).

The volume average particle diameter of the toner is typically 5.5 μm or smaller.

A ratio (Dv/Dn) of the number average particle diameter (Dn) of the toner to the volume average particle diameter (Dv) of the toner is typically 1.4 or less. As the ratio (Dv/Dn) is 1.4 or less, a distribution of the charge amount of the toner is even, and therefore a high quality image can be formed without causing background depositions. In this case, moreover, a transferring rate can be improved in an electrostatic transfer system.

The particle size distribution of the toner can be measured by means of Coulter Counter TA-II, or Coulter Multisizer II (both manufactured by Bechman Coulter, Inc.

The carrier preferably contains a core material, and a protective layer formed on a surface of the core material.

The core material is not particularly limited, and examples thereof include iron powder, ferrite powder, and magnetite power.

The protective layer contains a resin.

The resin is not particularly limited, and examples thereof include a urea-formaldehyde resin, a melamine resin, a benzoguanamine resin, a urea resin, polyamide, an epoxy resin, a vinyl-based resin, a vinylidene-based resin, an acryl resin, polymethyl methacrylate, polyacrylonitrile, polyvinyl acetate, polyvinyl alcohol, polyvinyl butyral, polystyrene, a styrene-acryl copolymer, a halogenated olefin resin (e.g., polyvinyl chloride), polyester (e.g., polyethylene terephthalate, and polybutylene terephthalate), polycarbonate, polyethylene, polyvinyl fluoride, polyvinylidene fluoride, polytrifluoroethylene, polyhexafluoropropylene, a copolymer of vinylidene fluoride and an acryl monomer, a copolymer of vinylidene fluoride and vinyl fluoride, a fluoroterpolymer of tetrafluoroethylene, vinylidene fluoride, and a non-fluoromonomer, and a silicone resin.

The protective layer may further contain electrically conductive powder.

The electrically conductive particle is not particularly limited, and examples thereof include powder of metal, carbon black, and powder of metal oxide (e.g., titanium oxide, tin oxide, and zinc oxide).

The average particle diameter of the electrically conductive powder is typically 1 μm or smaller. Use of the electrically conductive powder having such the average particle diameter can make control of electric resistance easy.

The average particle diameter of the carrier is typically about 20 μm to about 200 μm.

A mass ratio of the toner to the carrier is typically 0.01 to 0.1.

EXAMPLES

Examples of the present invention are explained hereinafter, but Examples shall not be construed as to limit the scope of the present invention. Note that, "part(s)" described in Examples means "part(s) by mass."

(Production of Elastic Member 1)

Elastic Member 1, which was in the shape of a flat plate, and had the average thickness of 1.8 mm, the length of 11.5 mm, and the width of 32.6 mm, was obtained in the same manner as Example 1 of JP-A No. 2011-141449. Elastic Member 1 had the JIS-A hardness of 68 degrees, and the repulsion elasticity modulus of 30%.

(Production of Elastic Member 2)

Elastic Member 2, which had a two-layer structure, and had the average thickness of 1.8 mm, the length of 11.5 mm, and the width of 32.6 mm, was obtained in the same manner as Example 2 of JP-A No. 2011-141449. The side of Elastic Member 2, which was in contact with the image bearing member, had the JIS-A hardness of 80 degrees, and the side thereof which was not in contact with the image bearing member had the JIS-A hardness of 75 degrees. Elastic Member 2 had the repulsion elasticity modulus of 25%.

<JIS-A Hardness of Elastic Member>

The JIS-A hardness of the elastic member was measured by means of a micro rubber hardness tester MD-1 (manufactured by KOBUNSHI KEIKI CO., LTD.) in accordance with JIS K6253. Note that, as for the elastic member having a two-layer structure, the JIS-A hardness of the elastic member was measured on the both sides.

<Repulsion Elasticity Modulus of Elastic Member>

The repulsion elasticity modulus of the elastic member was measured by No. 221 resilience tester (manufactured by TOYO SEIKI SEISAKU-SHO, LTD.) in accordance with JIS K6255. Note that, the repulsion elasticity modulus of the elastic member was measured using a measurement sample, which was prepared by laminating sheets each having a thickness of about 2 mm to give a total thickness of 4 mm or greater.

(Preparation of Coating Material 1)

Chemical Formula (1)

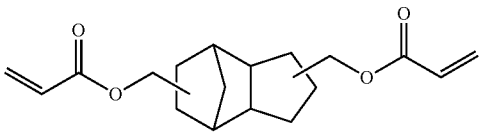

Coating Material 1 was obtained by mixing 50 parts of A-DCP (tricyclo[5.2.1.0]decanedimethanol diacrylate [molecular weight: 304])(manufactured by Shin-Nakamura Chemical Co., Ltd.) represented by the chemical formula (1), 5 parts of a polymerization initiator IRGACURE184 (manufactured by BASF), and 55 parts of cyclohexanone.

(Preparation of Coating Material 2)

Chemical Formula (2)

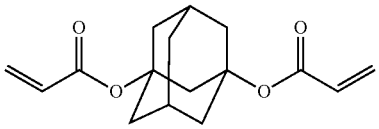

Coating Material 2 was obtained by mixing 50 parts of X-DA (1,3-bisacryloyloxyadamantane [molecular weight: 276 to 304])(manufactured by Idemitsu Kosan Co, Ltd.) represented by the chemical formula (2), 5 parts of a polymerization initiator IRGACURE 184 (manufactured by BASF), and 55 parts of cyclohexanone.

(Preparation of Coating Material 3)

Chemical Formula (3)

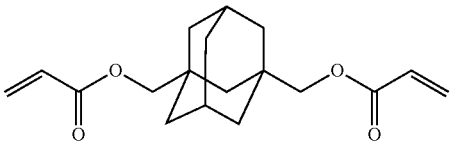

Coating Material 3 was obtained by mixing 50 parts of X-A-201 (1,3-adamantanedimethanol diacrylate [molecular weight: 304])(manufactured by Idemitsu Kosan Co, Ltd.) represented by the chemical formula (3), 5 parts of a polymerization initiator IRGACURE184 (manufactured by BASF), and 55 parts of cyclohexanone.

(Preparation of Coating Material 4)

Chemical Formula (4)

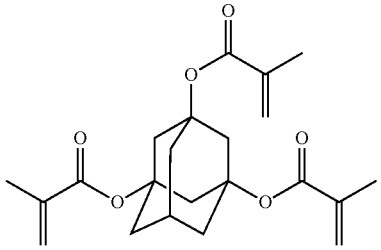

Coating Material 4 was obtained by mixing 50 parts of DIAPURESTE ADTM (1,3,5-trismethacryloyloxy adamantane [molecular weight 388])(manufactured by Mitsubishi Gas Chemical Company, Inc.) represented by the chemical formula (4), 5 parts of a polymerization initiator IRGACURE184 (manufactured by BASF), and 55 parts of cyclohexanone.

(Preparation of Coating Material 5)

Coating Material 5 was obtained by mixing 25 parts of A-DCP (tricyclo[5.2.1.0]decanedimethanol dimethacrylate [molecular weight: 304])(manufactured by Shin-Nakamura Chemical Co., Ltd.), 25 parts of PETIA (pentaerythritol triacrylate [molecular weight: 298])(manufactured by DAICEL-ALLNEX LTD.), represented by the following chemical formula (5), 5 parts of a polymerization initiator IRGACURE184 (manufactured by BASF), and 55 parts of cyclohexanone.

Chemical Formula (5)

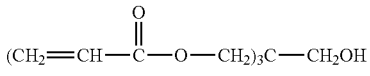

(Preparation of Coating Material 6)

Coating Material 6 was obtained by mixing 25 parts of X-A-201 (1,3-adamantanedimethanol diacrylate [molecular weight: 304])(manufactured by Idemitsu Kosan Co, Ltd.), 25 parts of PETIA (pentaerythritol triacrylate [molecular weight: 298])(manufactured by DAICEL-ALLNEX LTD.), 5 parts by mass of a polymerization initiator IRGACURE184 (manufactured by BASF), and 55 parts of cyclohexanone.

(Preparation of Coating Material 7)

Coating Material 7 was obtained by mixing 50 parts of ETIA (pentaerythritol triacrylate [molecular weight: 298])

(manufactured by DAICEL-ALLNEX LTD.), 5 parts of a polymerization initiator IRGACURE184 (manufactured by BASF), and 55 parts of cyclohexanone.

(Preparation of Coating Material 8)

Chemical Formula (6)

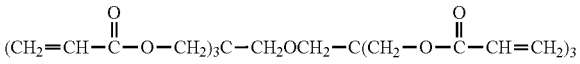

Coating Material 8 was obtained by mixing 50 parts of DPHA (dipentaerythritol hexaacrylate [molecular weight: 578])(manufactured by DAICEL-ALLNEX LTD.), 5 parts of a polymerization initiator IRGACURE184 (manufactured by BASF), and 55 parts of cyclohexanone.

(Production of Cleaning Blade 1)

After dipping a part of Elastic Member 1, which was 2 mm from the edge thereof from the side that would be in contact with an image bearing member, in Coating Material 1 for 2 hours, Elastic Member 1 was air dried for 3 minutes. Subsequently, ultraviolet rays were applied 5 times with a conveying speed of 5 m/min, by means of a black light UVC-2534/1MNLC3 (manufactured by USHIO INC.), an output of which was 140 W/cm, followed by drying Elastic Member 1 for 15 minutes at 100° C. by means of a heat dryer. Moreover, the obtained elastic member was fixed to a metal plate holder serving as a support member, with an adhesive, to thereby obtain Cleaning Blade 1.

(Production of Cleaning Blade 2)

Cleaning Blade 2 was obtained in the same manner as the production of Cleaning Blade 1, provided that Coating Material 1 was replaced with Coating Material 2.

(Production of Cleaning Blade 3)

Cleaning Blade 3 was obtained in the same manner as the production of Cleaning Blade 1, provided that Coating Material 1 was replaced with Coating Material 3.

(Production of Cleaning Blade 4)

Cleaning Blade 4 was obtained in the same manner as the production of Cleaning Blade 1, provided that Coating Material 1 was replaced with Coating Material 4.

(Production of Cleaning Blade 5)

Cleaning Blade 5 was obtained in the same manner as the production of Cleaning Blade 1, provided that Coating Material 1 was replaced with Coating Material 5.

(Production of Cleaning Blade 6)

Cleaning Blade 6 was obtained in the same manner as the production of Cleaning Blade 1, provided that Coating Material 1 was replaced with Coating Material 6.

(Production of Cleaning Blade 7)

Cleaning Blade 7 was obtained in the same manner as the production of Cleaning Blade 1, provided that Elastic Member 1 was replaced with Elastic Member 2.

(Production of Cleaning Blade 8)

Cleaning Blade 8 was obtained in the same manner as the production of Cleaning Blade 2, provided that Elastic Member 1 was replaced with Elastic Member 2.

(Production of Cleaning Blade 9)

Cleaning Blade 9 was obtained by fixing Elastic Member 1 to a metal plate holder serving as a support member with an adhesive.

(Production of Cleaning Blade 10)

Cleaning Blade 10 was obtained in the same manner as the production of Cleaning Blade 1, provided that Coating Material 1 was replaced with Coating Material 7.

(Production of Cleaning Blade 11)

Cleaning Blade 11 was obtained in the same manner as the production of Cleaning Blade 1, provided that Coating Material 1 was replaced with Coating Material 8.

Production conditions of the cleaning blades are presented in Table 1.

TABLE 1

| Cleaning Blade | Elastic Member | Coating Material |
|---|---|---|
| 1 | 1 | 1 |
| 2 | 1 | 2 |
| 3 | 1 | 3 |
| 4 | 1 | 4 |
| 5 | 1 | 5 |
| 6 | 1 | 6 |
| 7 | 2 | 1 |
| 8 | 2 | 2 |
| 9 | 1 | — |
| 10 | 1 | 7 |
| 11 | 1 | 8 |

(Preparation of Undercoat Layer Coating Liquid)

An undercoat layer coating liquid was obtained by mixing 3 parts of an alkyd resin BECKOSOL 1307-60-EL (manufactured by DIC Corporation), 2 parts of a melamine resin SUPER BECKAMINE G-821-60 (manufactured by DIC Corporation), 20 parts of titanium oxide CR-EL (manufactured by ISHIHARA SANGYO KAISHA, LTD.), and 100 parts of methyl ethyl ketone.

(Preparation of Charge Generation Layer Coating Liquid)

Chemical Formula (7)

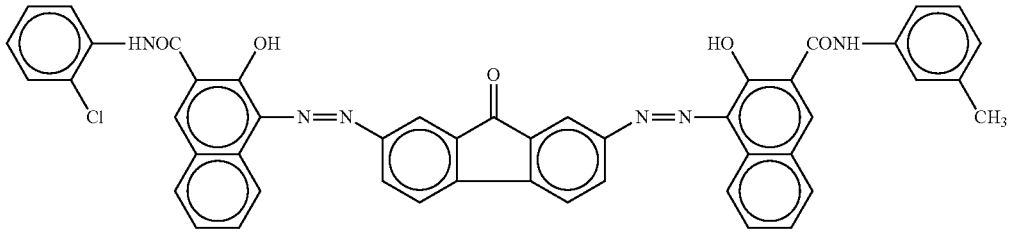

A charge generation layer coating liquid was obtained by mixing 5 parts of a bisazo pigment represented by the chemical formula (7), 1 part of polyvinyl butyral XYHL (manufactured by Union Carbide Corporation), 100 parts of 2-butanone, and 200 parts of cyclohexanone.

(Preparation of Charge Transport Layer Coating Liquid 1)

Charge Transport Layer Coating Liquid 1 was obtained by mixing 1 part of bisphenol Z polycarbonate TS2050 (manufactured by Teijin Limited), 1 part of the low molecular-weight charge transport material represented by the following chemical formula (8), and 10 parts of tetrahydrofuran.

Chemical Formula (8)

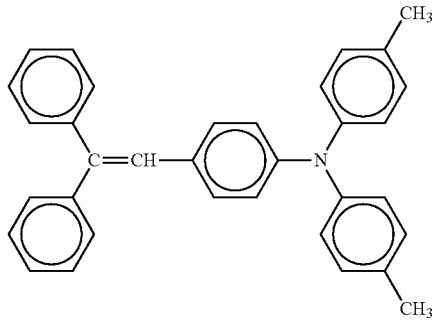

provided that the silica particles KMPX100 (manufactured by Shin-Etsu Chemical Co., Ltd.) were replaced with alumina particles AA03 (manufactured by Sumitomo Chemical Co., Ltd.).

(Preparation of Surface Layer Coating Liquid 3)

Surface Layer Coating Liquid 3 was obtained in the same manner as the preparation of Surface Layer Coating Liquid 2, provided that the amounts of the bisphenol Z polycarbonate TS2050 (manufactured by Teijin Limited) and the alumina particles AA03 (manufactured by Sumitomo Chemical Co., Ltd.) were changed to 6 parts and 1 part, respectively.

(Preparation of Surface Layer Coating Liquid 4)

Surface Layer Coating Liquid 4 was obtained in the same manner as the preparation of Surface Layer Coating Liquid 2, provided that 3 parts of the low molecular-weight charge transport material represented by the chemical formula (8) and 4 parts of bisphenol Z polycarbonate TS2050 (manufactured by Teijin Limited) were replaced with 7 parts of the high molecular-weight charge transport material having the viscosity average molecular weight of 65,000, which was represented by the following chemical formula (9).

Chemical Formula (9)

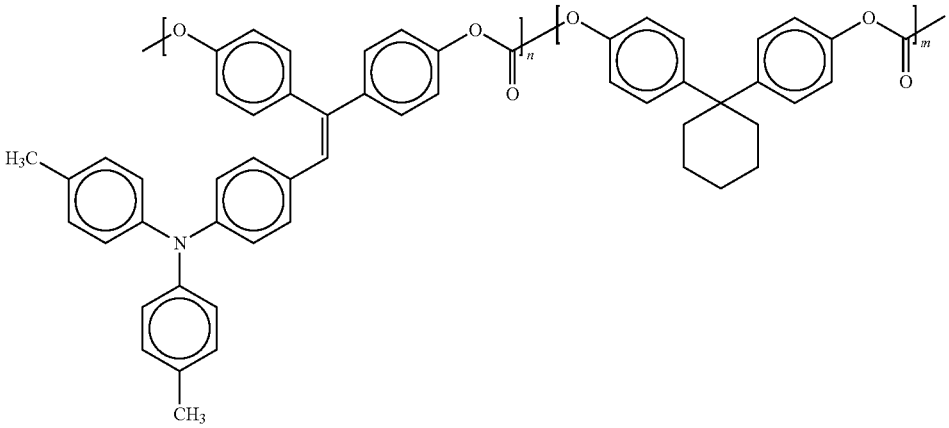

(Preparation of Charge Transport Layer Coating Liquid 2)

Charge Transport Layer Coating Liquid 2 was obtained by mixing 10 parts of bisphenol Z polycarbonate TS2050 (manufactured by Teijin Limited), 9 parts of the low molecular-weight charge transport material represented by the chemical formula (8), 1 part of alumina particles AA03 (manufactured by Sumitomo Chemical Co., Ltd.), and 100 parts of tetrahydrofuran.

(Preparation of Surface Layer Coating Liquid 1)

Surface Layer Coating Liquid 1 was obtained by mixing 3 parts of the low molecular-weight charge transport material represented by the chemical formula (8), 4 parts of bisphenol Z polycarbonate TS2050 (manufactured by Teijin Limited), 3 parts of silica particles KMPX100 (manufactured by Shin-Etsu Chemical Co., Ltd.), 170 parts of tetrahydrofuran, and 50 parts of cyclohexanone.

(Preparation of Surface Layer Coating Liquid 2)

Surface Layer Coating Liquid 2 was obtained in the same manner as the preparation of Surface Layer Coating Liquid 1, In the formula above, n is 2.3, and m is 3.2.

(Preparation of Surface Layer Coating Liquid 5)

Surface Layer Coating Liquid 5 was obtained in the same manner as the preparation of Surface Layer Coating Liquid 1, provided that the amounts of the low molecular-weight charge transport material represented by the chemical formula (8) and bisphenol Z polycarbonate TS2050 (manufactured by Teijin Limited) were changed to 4 parts, and 5 parts, respectively, and the silica particles KMPX100 (manufactured by Shin-Etsu Chemical Co., Ltd.) were not added.

(Preparation of Surface Layer Coating Liquid 6)

Surface Layer Coating Liquid 6 was obtained in the same manner as the preparation of Surface Layer Coating Liquid 1, provided that the silica particles KMPX100 (manufactured by Shin-Etsu Chemical Co., Ltd.) were replaced with fluororesin particles TLP10F-1 (manufactured by Du Pont-Mitsui Fluorochemicals Company, Ltd.).

(Preparation of Surface Layer Coating Liquid 7)

Surface Layer Coating Liquid 7 was obtained in the same manner as the preparation of Surface Layer Coating Liquid 1, provided that the silica particles KMPX100 (manufactured by Shin-Etsu Chemical Co., Ltd.) were replaced with cross-linked polymethyl methacrylate particles MP-1000 (manufactured by Soken Chemical & Engineering Co., Ltd.).

(Production of Image Bearing Member 1)

After applying the undercoat coating liquid on an aluminum element tube having an outer diameter of 40 mm through dip coating, the tube coated with the undercoated layer liquid was heated to dry, to thereby form an undercoat layer having a thickness of 3.5 μm. Subsequently, the charge generation layer coating liquid was applied on the undercoat layer through dip coating, followed by heating to dry, to thereby form a charge generation layer having the thickness of 0.2 μm. Moreover, Charge Transport Layer Coating Liquid 1 was applied onto the charge generation layer through dip coating, followed by heating to dry, to thereby form a charge transport layer having a thickness of 22 μm. Subsequently, Surface Layer Coating Liquid 1 was applied onto the charge transport layer through spray coating, followed by heating for 20 minutes at 150° C. to dry, to thereby form a surface layer having a thickness of 5 μm. As a result, Image Bearing Member 1 was obtained. Image Bearing Member 1 had Martens hardness of 189 N/mm$^2$, and the elastic work rate of 36.6%.

(Production of Image Bearing Member 2)

Image Bearing Member 2 was obtained in the same manner as the production of Image Bearing Member 1, provided that Surface Layer Coating Liquid 1 was replaced with Surface Layer Coating Liquid 2. Image Bearing Member 2 had Martens hardness of 196 N/mm$^2$, and the elastic work rate of 36.7%.

(Production of Image Bearing Member 3)

Image Bearing Member 3 was obtained in the same manner as the production of Image Bearing Member 1, provided that Surface Layer Coating Liquid 1 was replaced with Surface Layer Coating Liquid 3. Image Bearing Member 3 had Martens hardness of 186 N/mm$^2$, and the elastic work rate of 37.1%.

(Production of Image Bearing Member 4)

Image Bearing Member 4 was obtained in the same manner as the production of Image Bearing Member 1, provided that Surface Layer Coating Liquid 1 was replaced with Surface Layer Coating Liquid 4. Image Bearing Member 4 had Martens hardness of 197 N/mm$^2$, and the elastic work rate of 37.5%.

(Production of Image Bearing Member 5)

Image Bearing Member 5 was obtained in the same manner as the production of Image Bearing Member 1, provided that Surface Layer Coating Liquid 1 was replaced with Surface Layer Coating Liquid 5, to thereby form a surface layer having a thickness of 10 μm. Image Bearing Member 5 had Martens hardness of 185 N/mm$^2$, and the elastic work rate of 36.8%.

(Production of Image Bearing Member 6)

After applying the undercoat coating liquid on an aluminum element tube having an outer diameter of 40 mm through dip coating, the tube coated with the undercoated layer liquid was heated to dry, to thereby form an undercoat layer having a thickness of 3.5 μm. Subsequently, the charge generation layer coating liquid was applied on the undercoat layer through dip coating, followed by heating to dry, to thereby form a charge generation layer having the thickness of 0.2 μm. Moreover, charge transport layer coating liquid 2 was applied on the charge generation layer through dip coating, followed by heating to dry, to thereby form a charge transport layer having a thickness of 27 μm. As a result, Image Bearing Member 6 was obtained. Image Bearing Member 6 had Martens hardness of 182 N/mm$^2$, and the elastic work rate of 41.2%.

(Production of Image Bearing Member 7)

Image Bearing Member 7 was obtained in the same manner as the production of Image Bearing Member 6, provided that Charge Transport Layer Coating Liquid 2 was replaced with Charge Transport Layer Coating Liquid 1. Image Bearing Member 7 had Martens hardness of 177 N/mm$^2$, and the elastic work rate of 41.5%.

(Production of Image Bearing Member 8)

Image Bearing Member 8 was obtained in the same manner as the production of Image Bearing Member 1, provided that Surface Layer Coating Liquid 1 was replaced with Surface Layer Coating Liquid 6. Image Bearing Member 8 had Martens hardness of 180 N/mm$^2$, and the elastic work rate of 37.1%.

(Production of Image Bearing Member 9)

Image Bearing Member 9 was obtained in the same manner as the production of Image Bearing Member 1, provided that Surface Layer Coating Liquid 1 was replaced with Surface Layer Coating Liquid 7 to form a surface layer having a thickness of 10 μm. Image Bearing Member 9 had Martens hardness of 182 N/mm$^2$, and the elastic work rate of 37.5%.

<Martens Hardness and Elastic Work Rate>

The Martens hardness and elastic work rate (We/Wt) of a surface of the image bearing member where the surface layer was formed was measured by means of a micro surface hardness tester Fisherscope H-100 (manufactured by Fischer Technology, Inc.) under the following conditions.

Test method: loading-unloading repeating (once) test

Indenter: Micro-Vickers indenter

Maximum load: 9.8 mN

Loading (unloading) time: 30 s

Retention time: 5 s

The properties of the image bearing members are presented in Table 2.

TABLE 2

| Image Bearing Member | Martens hardness [N/mm$^2$] | Elastic work rate [%] |
|---|---|---|
| 1 | 189 | 36.6 |
| 2 | 196 | 36.7 |
| 3 | 186 | 37.1 |
| 4 | 197 | 37.5 |
| 5 | 185 | 36.8 |
| 6 | 182 | 41.2 |
| 7 | 177 | 41.5 |
| 8 | 180 | 37.1 |
| 9 | 182 | 37.5 |

Example 1-1

Cleaning Blade 1 and Image Bearing Member 2 were mounted in iPSiO SP C811 (manufactured by Ricoh Company Limited) employing an intermediate transfer-system, to thereby obtain an image forming apparatus.

Example 1-2

An image forming apparatus was obtained in the same manner as in Example 1-1, provided that Cleaning Blade 1 was replaced with Cleaning Blade 2.

Example 1-3

An image forming apparatus was obtained in the same manner as in Example 1-1, provided that Cleaning Blade 1 was replaced with Cleaning Blade 3.

Example 1-4

An image forming apparatus was obtained in the same manner as in Example 1-1, provided that Cleaning Blade 1 was replaced with Cleaning Blade 4.

Example 1-5

An image forming apparatus was obtained in the same manner as in Example 1-1, provided that Cleaning Blade 1 was replaced with Cleaning Blade 5.

Example 1-6

An image forming apparatus was obtained in the same manner as in Example 1-1, provided that Cleaning Blade 1 was replaced with Cleaning Blade 6.

Example 1-7

An image forming apparatus was obtained in the same manner as in Example 1-1, provided that Cleaning Blade 1 was replaced with Cleaning Blade 7.

Example 1-8

An image forming apparatus was obtained in the same manner as in Example 1-1, provided that Cleaning Blade 1 was replaced with Cleaning Blade 8.

Example 1-9

An image forming apparatus was obtained in the same manner as in Example 1-4, provided that Image Bearing Member 2 was replaced with Image Bearing Member 1.

Example 1-10

An image forming apparatus was obtained in the same manner as in Example 1-4, provided that Image Bearing Member 2 was replaced with Image Bearing Member 3.

Example 1-11

An image forming apparatus was obtained in the same manner as in Example 1-4, provided that Image Bearing Member 2 was replaced with Image Bearing Member 4.

Example 1-12

An image forming apparatus was obtained in the same manner as in Example 1-4, provided that Image Bearing Member 2 was replaced with Image Bearing Member 6.

Example 1-13

An image forming apparatus was obtained in the same manner as in Example 1-4, provided that Image Bearing Member 2 was replaced with Image Bearing Member 8.

Example 1-14

An image forming apparatus was obtained in the same manner as in Example 1-4, provided that Image Bearing Member 2 was replaced with Image Bearing Member 9.

Comparative Example 1-1

An image forming apparatus was obtained in the same manner as in Example 1-1, provided that Cleaning Blade 1 was replaced with Cleaning Blade 9.

Comparative Example 1-2

An image forming apparatus was obtained in the same manner as in Example 1-1, provided that Cleaning Blade 1 was replaced with Cleaning Blade 10.

Comparative Example 1-3

An image forming apparatus was obtained in the same manner as in Example 1-1, provided that Cleaning Blade 1 was replaced with Cleaning Blade 11.

Comparative Example 1-4

An image forming apparatus was obtained in the same manner as in Example 1-4, provided that Image Bearing Member 2 was replaced with Image Bearing Member 5.

Comparative Example 1-5

An image forming apparatus was obtained in the same manner as in Comparative Example 1-2, provided that Image Bearing Member 2 was replaced with Image Bearing Member 5.

Comparative Example 1-6

An image forming apparatus was obtained in the same manner as in Example 1-4, provided that Image Bearing Member 2 was replaced with Image Bearing Member 7.

Subsequently, 10,000 sheets, and 50,000 sheets of an image were output by means of the aforementioned image forming apparatus in the environment of 22° C., and 55% RH under the following conditions, followed by evaluating a roll-up amount of the cleaning blade, cleaning properties, an abrasion amount of the cleaning blade, an abrasion amount of the image bearing member, and foreign matter adherence to the image bearing member.

Sheet for use: My Paper A4 (manufactured by RICOH JAPAN Corporation)

Station for use: Black

Image area rate: 0%, 10%, 50% (different image area rates in the identical chart)

<Rolled-Up Amount of Cleaning Blade>

The cleaning blade was rubbed against a glass plate, on which a layer material, which was identical to the layer material formed at the surface of the image bearing member where the photoconductive layer was formed, was formed, at the biting amount of 0.88 mm, and the setting angle of 22.6°. During this operation, a contact state of the cleaning blade was observed from the back side of the glass plate, and a rolled-up length [μm] of the end ridge part of the elastic member of the cleaning blade was measured from the output image by means of a CCD camera Nikon CM-5 (manufactured by Nikon Corporation).

<Cleaning Properties>

After outputting 20 sheets of a chart (A4 size, wide-side up orientation), a pattern of which contained 3 longitudinal bands each having a width of 43 mm, along the traveling direction of the sheet, the image was output and the output image was visually observed to evaluate cleaning properties.

The evaluation results of the rolled-up amount of the cleaning blade, cleaning properties, abraded amount of the cleaning blade, abraded amount of the image bearing member, and adherence of foreign matter to the image bearing member are presented in Tables 3 and 4. Note that, "-" in the tables denotes that it could not be evaluated.

TABLE 3

| | | | Rolled-up amount of cleaning blade | | Cleaning properties | | Abraded amount of cleaning blade | |
|---|---|---|---|---|---|---|---|---|
| | Cleaning Blade | Image bearing member | 10,000 sheets | 50,000 sheets | 10,000 sheets | 50,000 sheets | 10,000 sheets | 50,000 sheets |
| Ex. 1-1 | 1 | 2 | 1 | 1 | A | A | 3 | 12 |
| Ex. 1-2 | 2 | 2 | 0 | 0 | A | B | 6 | 25 |
| Ex. 1-3 | 3 | 2 | 0 | 0 | A | A | 3 | 11 |
| Ex. 1-4 | 4 | 2 | 1 | 1 | A | A | 3 | 11 |
| Ex. 1-5 | 5 | 2 | 0 | 1 | A | A | 4 | 15 |
| Ex. 1-6 | 6 | 2 | 1 | 1 | A | A | 4 | 16 |
| Ex. 1-7 | 7 | 2 | 0 | 0 | A | A | 2 | 9 |
| Ex. 1-8 | 8 | 2 | 0 | 0 | A | A | 3 | 8 |
| Ex. 1-9 | 4 | 1 | 1 | 1 | A | A | 5 | 14 |
| Ex. 1-10 | 4 | 3 | 1 | 1 | A | A | 4 | 13 |
| Ex. 1-11 | 4 | 4 | 1 | 1 | A | A | 4 | 12 |
| Ex. 1-12 | 4 | 6 | 1 | 1 | A | A | 4 | 11 |
| Ex. 1-13 | 4 | 8 | 1 | 1 | A | A | 4 | 15 |
| Ex. 1-14 | 4 | 9 | 1 | 1 | A | A | 3 | 11 |
| Comp. Ex. 1-1 | 9 | 2 | 15 | 25 | C | C | 35 | — |
| Comp. Ex. 1-2 | 10 | 2 | 12 | 20 | B | C | 21 | — |
| Comp. Ex. 1-3 | 11 | 2 | 8 | 12 | B | C | 28 | — |
| Comp. Ex. 1-4 | 4 | 5 | 1 | — | A | — | 3 | — |
| Comp. Ex. 1-5 | 10 | 5 | 3 | — | C | — | 6 | — |
| Comp. Ex. 1-6 | 4 | 7 | 3 | — | C | — | 5 | — |

A case where there was no defective image was judged as "A," the case where the defective image was locally present was judged as "B," and a case where the defective image was present in the entire image was judged as "C." The term "defective image" means an image appeared as lines, or bands, or white missing spots appeared in a solid image area.

<Abraded Amount of Cleaning Blade>

Figure 12:
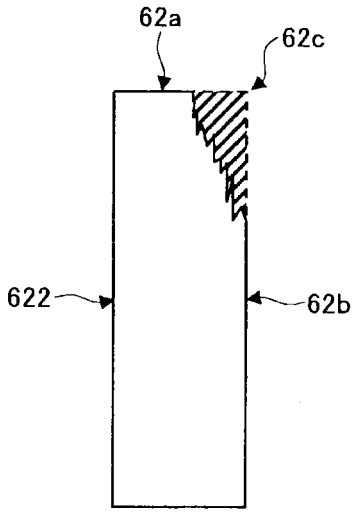
FIG. 12 is a diagram illustrating a measuring method of an abraded amount of the cleaning blade.

An abraded width [μm] from an edge plane 62*a* of the end ridge part 62*c* of the elastic member 622 was measured by means of a laser microscope VK-9510 (manufactured by Keyence Corporation) (see FIG. 12).

<Abraded Amount of Image Bearing Member>

A film thickness was measured by means of Fisherscope eddy current film thickness meter MMS at arbitrarily selected 5 positions in the each image area rate part, and then a reduction amount [μm] of the film thickness from the initial film thickness.

<Foreign Matter Adherence on Image Bearing Member>

The surface of the image bearing member was observed visually and through a laser microscope VK-9510 (manufactured by Keyence Corporation), and adherence of foreign matter to the image bearing member was evaluated. A case where no foreign matter was adhered to the surface of the image bearing member was evaluated as "A," a case where adherence of foreign matter was observed locally on the image bearing member was judged as "B," and a case where adherence of foreign matter was observed on an entire surface of the image bearing member was judged as "C."

TABLE 4

| | Abraded amount of image bearing member | | | | | | Foreign matter adherence to image bearing member | |
|---|---|---|---|---|---|---|---|---|
| | 10,000 sheets | | | 50,000 sheets | | | 10,000 sheets | 50,000 sheets |
| | 0% | 10% | 50% | 0% | 10% | 50% | | |
| Ex. 1-1 | 0.4 | 0.4 | 0.5 | 2.0 | 2.0 | 2.3 | A | A |
| Ex. 1-2 | 0.3 | 0.3 | 0.4 | 1.6 | 1.6 | 1.8 | A | B |
| Ex. 1-3 | 0.3 | 0.3 | 0.4 | 1.6 | 1.6 | 1.8 | A | A |
| Ex. 1-4 | 0.3 | 0.3 | 0.4 | 1.6 | 1.4 | 1.8 | A | A |
| Ex. 1-5 | 0.3 | 0.3 | 0.3 | 1.3 | 1.4 | 1.5 | A | A |
| Ex. 1-6 | 0.3 | 0.3 | 0.4 | 1.6 | 1.7 | 1.8 | A | A |
| Ex. 1-7 | 0.3 | 0.2 | 0.2 | 1.3 | 1.2 | 1.1 | A | A |
| Ex. 1-8 | 0.3 | 0.3 | 0.4 | 1.6 | 1.6 | 1.8 | A | A |
| Ex. 1-9 | 0.5 | 0.6 | 0.6 | 2.6 | 3.1 | 3.0 | A | A |
| Ex. 1-10 | 0.2 | 0.2 | 0.2 | 1.1 | 1.2 | 1.2 | A | A |
| Ex. 1-11 | 0.2 | 0.2 | 0.2 | 0.8 | 1.0 | 1.1 | A | A |
| Ex. 1-12 | 1.2 | 1.4 | 1.4 | 6.1 | 7.1 | 6.9 | A | B |
| Ex. 1-13 | 0.5 | 0.6 | 0.8 | 3.5 | 3.5 | 3.8 | A | B |
| Ex. 1-14 | 0.4 | 0.5 | 0.7 | 3.2 | 3.4 | 3.6 | A | B |
| Comp. Ex. 1-1 | 0.2 | 0.4 | 0.5 | 1.2 | 1.9 | 2.7 | A | B |
| Comp. Ex. 1-2 | 0.2 | 0.3 | 0.5 | 1.0 | 1.6 | 2.4 | A | B |
| Comp. Ex. 1-3 | 0.3 | 0.3 | 0.5 | 1.3 | 1.5 | 2.3 | A | B |
| Comp. Ex. 1-4 | 6.5 | 6.9 | 8.9 | — | — | — | B | C |

TABLE 4-continued

| | Abraded amount of image bearing member | | | | | | Foreign matter adherence to image bearing member | |
|---|---|---|---|---|---|---|---|---|
| | 10,000 sheets | | | 50,000 sheets | | | 10,000 | 50,000 |
| | 0% | 10% | 50% | 0% | 10% | 50% | sheets | sheets |
| Comp. Ex. 1-5 | 7.1 | 8.8 | 9.8 | — | — | — | C | C |
| Comp. Ex. 1-6 | 2.5 | 2.9 | 3.1 | — | — | — | C | C |

It can be understood from Table 3 that the image forming apparatuses of Examples 1-1 to 1-12 have low values in the rolled-up amount of the cleaning blade, the abraded amount of the cleaning blade, and the abraded amount of the image bearing member, have excellent cleaning properties, and can prevent adherence of foreign matter to the image bearing member.

On the other hand, the image forming apparatus of Comparative Example 1-1 has large values in the rolled-up amount of the cleaning blade, and the abraded amounts, and has insufficient cleaning properties, as used is Cleaning Blade 9 containing the uncured coating material containing a curing agent in the region of the cleaning blade that is to be in contact with the image bearing member.

The image forming apparatuses of Comparative Examples 1-2 and 1-3 have large values in the rolled-up amount of the cleaning blade, and the abraded amounts, and has insufficient cleaning properties, as the cleaning blades 10, 11, which contain cured Coating Materials 7 and 8, respectively, each of which does not contain a curing agent having an alicyclic hydrocarbon group and a (meth)acryloyloxy group, are used.

The image forming apparatus of Comparative Example 1-4 has a large value in the abraded amount of the image bearing member, and causes adherence of foreign matter to the image bearing member, as Image Bearing Member 5, in which the surface layer that does not contain particles is formed, is used.

The image forming apparatus of Comparative Example 1-5 has a large value in the abraded amount of the image bearing member, has insufficient cleaning properties, and causes adherence of foreign matter to the image bearing member, as Cleaning Blade 10 containing cured Coating Material 7, which does not contain an alicyclic hydrocarbon group and a (meth)acryloyloxy group, and Image Bearing Member 5, in which the surface layer that does not contain particles, are used.

The image forming apparatus of Comparative Example 1-6 has a large value in the abraded amount of the image bearing member, insufficient cleaning properties, and causes adherence of foreign matter to the image bearing member, as Image bearing Member 7, in which the charge transport layer that does not contain particles is formed, is used.

Example 2-1

Cleaning Blade 1 and Image Bearing Member 2 were mounted in imagio MP 3352 (manufactured by Ricoh Company Limited) employing a direct transfer system, to thereby obtain an image forming apparatus.

Example 2-2

An image forming apparatus was obtained in the same manner as in Example 2-1, provided that Cleaning Blade 1 was replaced with Cleaning Blade 2.

Example 2-3

An image forming apparatus was obtained in the same manner as in Example 2-1, provided that Cleaning Blade 1 was replaced with Cleaning Blade 3.

Example 2-4

An image forming apparatus was obtained in the same manner as in Example 2-1, provided that Cleaning Blade 1 was replaced with Cleaning Blade 4.

Example 2-5

An image forming apparatus was obtained in the same manner as in Example 2-1, provided that Image Bearing Member 2 was replaced with Image Bearing Member 4.

Example 2-6

An image forming apparatus was obtained in the same manner as in Example 2-5, provided that Cleaning Blade 1 was replaced with Cleaning Blade 2.

Example 2-7

An image forming apparatus was obtained in the same manner as in Example 2-5, provided that Cleaning Blade 1 was replaced with Cleaning Blade 3.

Example 2-8

An image forming apparatus was obtained in the same manner as in Example 2-5, provided that Cleaning Blade 1 was replaced with Cleaning Blade 4.

Comparative Example 2-1

An image forming apparatus was obtained in the same manner as in Example 2-1, provided that Cleaning Blade 1 was replaced with Cleaning Blade 9.

Comparative Example 2-2

An image forming apparatus was obtained in the same manner as in Example 2-1, provided that Cleaning Blade 1 was replaced with Cleaning Blade 10.

Comparative Example 2-3

An image forming apparatus was obtained in the same manner as in Example 2-1, provided that Cleaning Blade 1 was replaced with Cleaning Blade 11.

Comparative Example 2-4

An image forming apparatus was obtained in the same manner as in Example 2-4, provided that Image Bearing Member 2 was replaced with Image Bearing Member 5.

Comparative Example 2-5

An image forming apparatus was obtained in the same manner as in Comparative Example 2-2, provided that Image Bearing Member 2 was replaced with Image Bearing Member 5.

Subsequently, 10,000 sheets, and 50,000 sheets of an image were output by means of the aforementioned image forming apparatus in the environment of 22° C., and 55% RH under the following conditions, followed by evaluating cleaning properties, and foreign matter adherence to the image bearing member in the same manners as described earlier.

Sheet for use: My Paper A4 (manufactured by RICOH JAPAN Corporation)

Station for use: Black

Image area rate: 5%

The evaluation results of the cleaning properties and foreign matter adherence to the image bearing member are presented in Table 5. Note that, "-" in the table denotes that it could not be evaluated.

TABLE 5

| | | | Cleaning properties | | Foreign matter adherence to image bearing member | |
|---|---|---|---|---|---|---|
| | Cleaning Blade | Image bearing member | 10,000 sheets | 50,000 sheets | 10,000 sheets | 50,000 sheets |
| Ex. 2-1 | 1 | 2 | A | A | A | B |
| Ex. 2-2 | 2 | 2 | A | A | A | B |
| Ex. 2-3 | 3 | 2 | A | A | A | B |
| Ex. 2-4 | 4 | 2 | A | A | A | B |
| Ex. 2-5 | 1 | 4 | A | A | A | A |
| Ex. 2-6 | 2 | 4 | A | A | A | A |
| Ex. 2-7 | 3 | 4 | A | A | A | A |
| Ex. 2-8 | 4 | 4 | A | A | A | A |
| Comp. Ex. 2-1 | 9 | 2 | C | C | B | C |
| Comp. Ex. 2-2 | 10 | 2 | C | C | B | C |
| Comp. Ex. 2-3 | 11 | 2 | B | C | A | C |
| Comp. Ex. 2-4 | 4 | 5 | B | — | B | C |
| Comp. Ex. 2-5 | 10 | 5 | C | — | C | C |

It can be understood from Table 5 that the image forming apparatuses of Examples 2-1 to 2-8 have excellent cleaning properties, and can prevent adherence of foreign matter to the image bearing member.

On the other hand, the image forming apparatus of Comparative Example 2-1 has insufficient cleaning properties, as used is Cleaning Blade 9 containing the uncured coating material containing a curing agent in the region of the cleaning blade that is to be in contact with the image bearing member.

The image forming apparatuses of Comparative Examples 2-2, 2-3, and 2-5 have insufficient cleaning properties, as used are Cleaning Blades 10, 11, in which Coating Materials 7, 8 that do not contain a curing agent having an alicyclic hydrocarbon group, and a (meth)acryloyloxy group are cured.

The image forming apparatuses of Comparative Examples 2-4, 2-5 cause adherence of foreign matter to the image bearing member, as Image Bearing Member 5, in which the surface layer that does not contain particles is formed, is used.

This application claims priority to Japanese application No. 2013-189310, filed on Sep. 12, 2013 and Japanese application No. 2014-126153, filed on Jun. 19, 2014, and incorporated herein by reference.

What is claimed is:

1. An image forming apparatus, comprising:

an image bearing member;

a charging unit configured to charge the image bearing member;

an exposing unit configured to expose the charged image bearing member to light to form an electrostatic latent image;

a developing unit configured to develop the electrostatic latent image formed on the image bearing member with a toner to form a toner image;

a transferring unit configured to transfer the toner image formed on the image bearing member to a recording medium; and a cleaning unit configured to clean the image bearing member from which the toner image has been transferred, wherein the image bearing member is an image bearing member including an electrically conductive support, a photoconductive layer formed on the electrically conductive support, and a surface layer including a binder resin and particles formed on a surface of the photoconductive layer, or an image bearing member including an electrically conductive support, and a photoconductive layer including a binder resin and particles formed on the electrically conductive support, wherein the cleaning unit includes a cleaning blade, which includes a cured composition including a curing agent in a region of the cleaning blade, which is to be in contact with the image bearing member, and wherein the curing agent includes a polycyclic aliphatic hydrocarbon group, and a (meth)acryloyloxy group.

2. The image forming apparatus according to claim 1, wherein the curing agent is a derivative of tricyclodecane.

3. The image forming apparatus according to claim 1, wherein the particles are inorganic particles.

4. The image forming apparatus according to claim 3, wherein the inorganic particles are oxide particles.

5. The image forming apparatus according to claim 4, wherein the oxide particles are oxide aluminum particles.

6. The image forming apparatus according to claim 1, wherein a Martens hardness of a surface of the image bearing member at the side where the photoconductive layer is formed is 190 $N/mm^2$ or greater, and an elastic work rate of the surface of the image bearing member at the side where the photoconductive layer is formed is 37.0% or greater.

7. The image forming apparatus according to claim 1, wherein the cleaning blade includes a laminate in which two or more kinds of rubbers having mutually different JIS-A hardnesses are integrally formed.

8. A process cartridge, comprising:

an image bearing member; and a cleaning unit configured to clean the image bearing member from which a toner image has been transferred, wherein the image bearing member is an image bearing member including an electrically conductive support, a photoconductive layer formed on the electrically conductive support, and a surface layer including a binder resin and particles formed on a surface of the photoconductive layer, or an image bearing member including an electrically conductive support, and a photoconductive layer including a binder resin and particles formed on the electrically conductive support, wherein the cleaning unit includes a cleaning blade, which includes a cured composition including a curing agent in a region of the cleaning blade, which is to be in contact with the image bearing member, and wherein the curing agent includes a polycyclic aliphatic hydrocarbon group, and a (meth)acryloyloxy group.

* * * * *